US011192378B2

(12) United States Patent
Marion et al.

(10) Patent No.: US 11,192,378 B2
(45) Date of Patent: Dec. 7, 2021

(54) INK JET PRINT HEAD WITH WATER PROTECTION

(71) Applicant: Dover Europe Sàrl, Vernier (CH)

(72) Inventors: Adrien Marion, Lyons (FR); Jean Xing, Bourg les Valence (FR); René Ferry, Geyssans (FR)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 16/719,323

(22) Filed: Dec. 18, 2019

(65) Prior Publication Data

US 2020/0207085 A1 Jul. 2, 2020

(30) Foreign Application Priority Data

Dec. 28, 2018 (EP) ..... 18248284

(51) Int. Cl.

| | |
|---|---|
| ***B41J 2/175*** | (2006.01) |
| ***B41J 2/085*** | (2006.01) |
| ***B41J 2/185*** | (2006.01) |
| ***B41J 2/095*** | (2006.01) |
| ***B41J 2/105*** | (2006.01) |
| ***B41J 2/135*** | (2006.01) |

(52) U.S. Cl.

CPC ..... *B41J 2/175* (2013.01); *B41J 2/085* (2013.01); *B41J 2/095* (2013.01); *B41J 2/105* (2013.01); *B41J 2/135* (2013.01); *B41J 2/185* (2013.01); *B41J 2202/02* (2013.01)

(58) Field of Classification Search

CPC ... B41J 2/175; B41J 2/085; B41J 2/185; B41J 2/095; B41J 2/105; B41J 2/135; B41J 2202/02

See application file for complete search history.

(56) References Cited

U.S. PATENT DOCUMENTS 7,192,121 B2 3/2007 Barbet et al.
7,604,332 B2 10/2009 Nagashima
(Continued)

FOREIGN PATENT DOCUMENTS

EP 3225400 A1 10/2017
EP 3225405 A1 10/2017
(Continued)

OTHER PUBLICATIONS

Search Report for European application No. EP18248284 dated Jun. 26, 2019.

*Primary Examiner* — Geoffrey S Mruk
(74) *Attorney, Agent, or Firm* — Pearne & Gordon LLP

(57) ABSTRACT

A method for operating a printhead of a continuous inkjet printer comprising: producing at least one ink jet in a cavity of the print head; electrostatically separating drops or sections of one or more of the jet intended for printing from drops or sections that do not serve for printing; exiting from the cavity drops or sections of ink intended for printing, through a slot open on the outside of the cavity; and circulating at least one flow of air along the outlet slot of the cavity in a direction essentially perpendicular to at least one jet of ink emitted by the printhead and intended for printing. The air having a water vapor pressure lower than the water vapor pressure defined by 100% relative humidity at the coldest temperature of the printer.

10 Claims, 15 Drawing Sheets

(56) References Cited

U.S. PATENT DOCUMENTS

| | | | | |
|---|---|---|---|---|
| 8,091,989 | B2 * | 1/2012 | Desse | B41J 2/14 347/74 |
| 8,540,350 | B2 | 9/2013 | Barbet | |
| 10,336,077 | B2 * | 7/2019 | Barbet | B41J 2/105 |
| 2010/0149233 | A1 | 6/2010 | Katerberg | |
| 2018/0339518 | A1 | 11/2018 | Xing et al. | |

FOREIGN PATENT DOCUMENTS

| | | | |
|---|---|---|---|
| FR | 2851495 | A1 | 8/2004 |
| FR | 2952851 | A1 | 5/2011 |
| WO | 2012038520 | A1 | 3/2012 |
| WO | 2017158048 | A2 | 9/2017 |

* cited by examiner

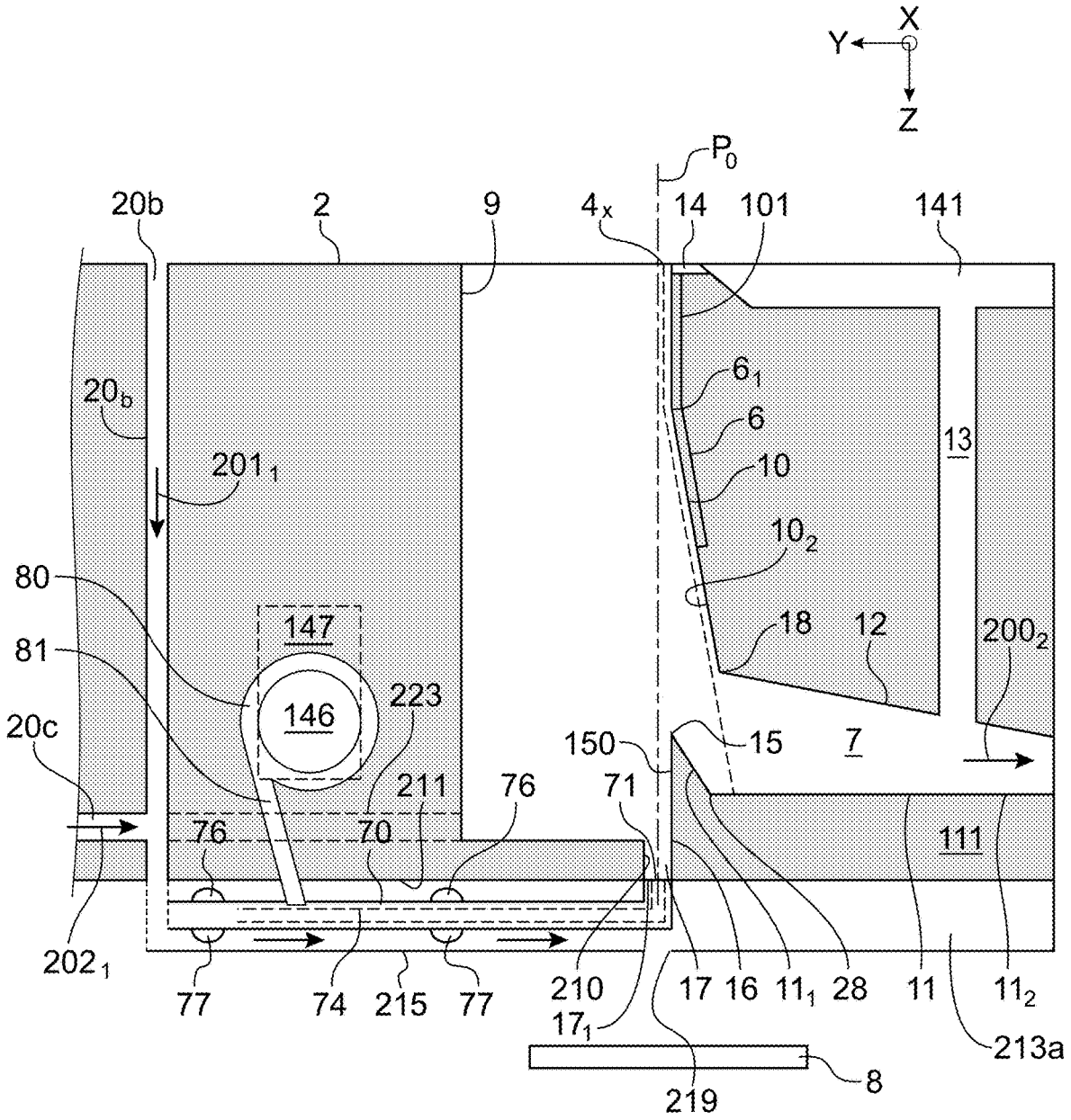
FIG.4A1

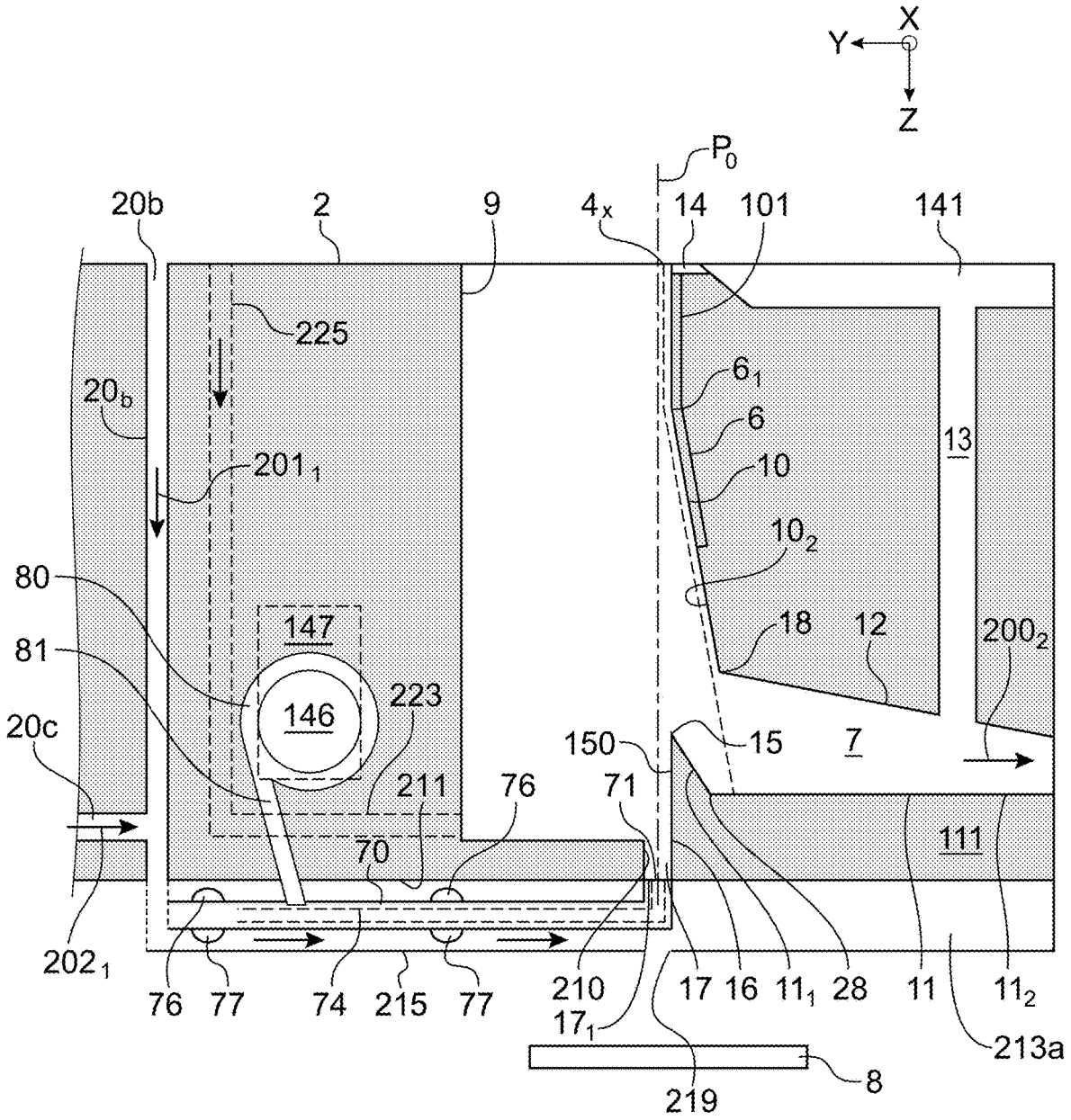
FIG.4A2

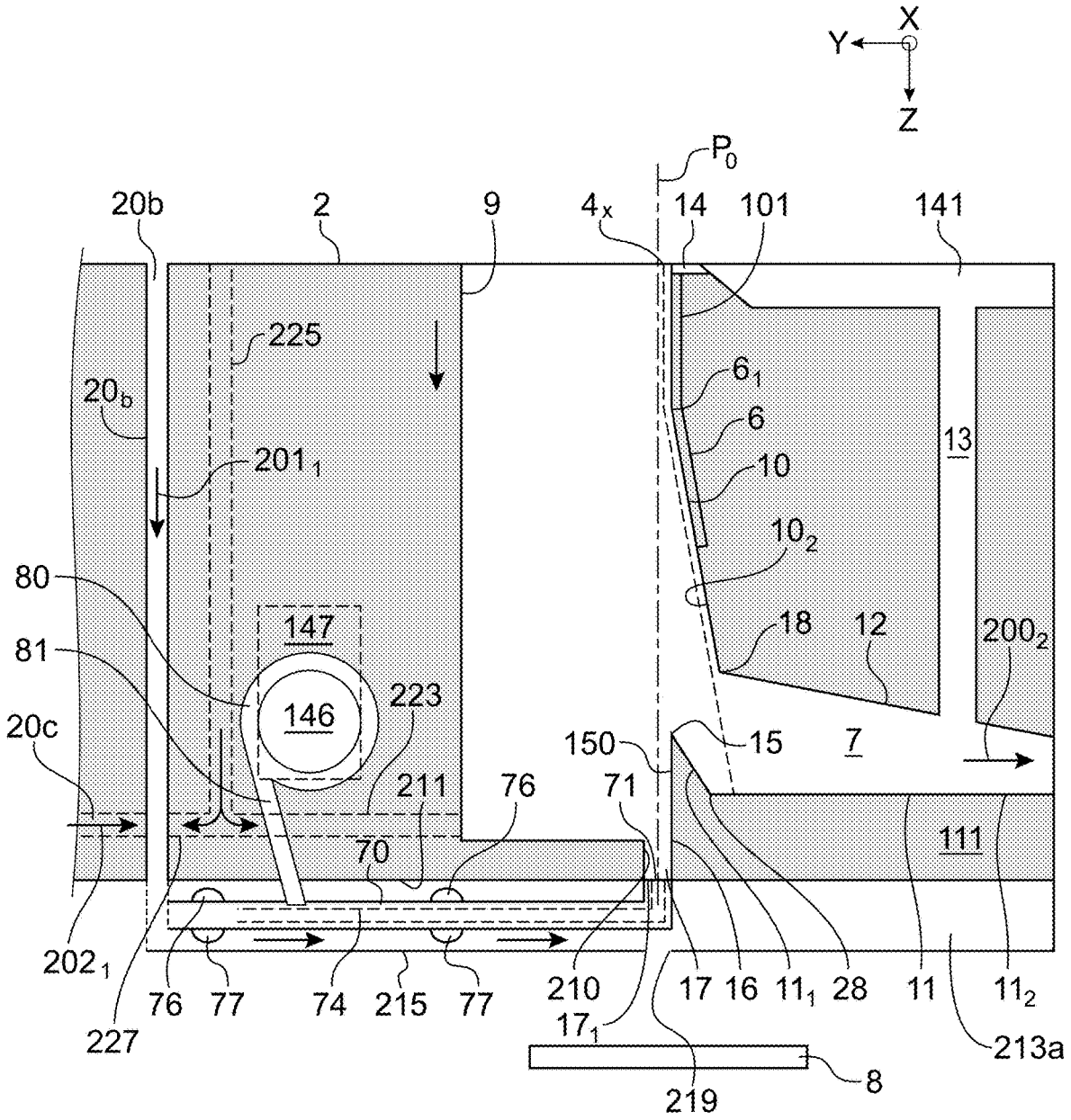
FIG.4A3

INK JET PRINT HEAD WITH WATER PROTECTION

CROSS-REFERENCE TO RELATED APPLICATIONS

This application claims priority from French Patent Application No. Ep 18248284.4 filed on Dec. 28, 2018. The content of this application is incorporated herein by reference in its entirety.

PRIOR ART AND TECHNICAL PROBLEMS

The invention notably applies to print heads of printers or to deviated continuous ink jet printers or to binary continuous ink jet printers provided with a multi-nozzle drop generator.

Ink used in known ink jet print head have a certain concentration of water. In a CIJ printer, said concentration may vary in a narrow range, for example from 0.5% to 5%. Beyond that range the ink can no longer be properly used to print.

The added water results from exchange with humid air from outside the print head and/or results from condensation of water vapor in the hydraulic system connected to the print head.

In some embodiments, the ink not used for printing is recirculated with help of a pump pumping both said ink and air, with a pumping rate of at least 10 l (air)/h.

CIJ print heads are fabricated to work in environments comprising 10% to 90% relative humidity, associated to temperature from 5° C. to 45° C., which is a source of water entering inside the head and the recirculation circuit.

Indeed, temperature variations to which the print head is subject will result in water condensation inside circuit.

More precisely, the vapor flow rate $Q_{vap}$ loaded by air can be calculated as follows:

$$Q_{vap} = M_w \frac{Q}{V_m(T)} \frac{P_{sat}(T)}{P_{atm}} HR[\text{g/h}]$$

where:

Q is the air flow rate (l/h);

$M_w$ is the molar mass of water (g/mol);

$P_{sat}$ (T) is the saturation vapor pressure (kPa);

$P_{atm}$ is the atmospheric pressure (kPa);

$V_m$(T) is the molar volume at temperature T, calculated as follows:

$$V_m(T) = \frac{8.3144 * (273.15 + T)}{P_{atm}} [\text{l/mol}]$$

For T=45° C.: $V_m(45)$=26.11 l/mol and $Q_{vap}$=0.58 g/h.

This shows that for T=45° C. and HR=90%, an air flow rate of 10 l/h loads 0.58 g/h water vapor. If the temperature drops a few degrees, for example 5° C., which is a very realistic situation for an ink jet printer, liquid water will condense. Thus, based on the saturated vapor pressure curve, for an air flow rate of 10 l/h, at a temperature of 45° C. and 90% relative humidity, a temperature reduction of 5° C. results in 10% condensation, which means 0.06 g/h or 0.07 $cm^3$/h of water added into the ink.

Furthermore, the volume of an ink circuit of a CIJ printer is about 11, which means about 850 g for an ink density of 0.85. The initial mass concentration of water being for example 0.5% (=4.25 g of water, or 0.43% of the volume). After 70 h of operation 70×0.06=4.2 *g* water have been added, which means *a* water mass concentration of 1% (the upper acceptable limit).

In real conditions, a printer is operated nearly continuously and the above calculations give results which are underestimated even though each printed drop is loaded with a certain quantity of water (if the printed ink flow rate is 1 l/month for 10 h daily use (200 h/month), the average printed ink flow rate is 5 $cm^3$/h).

An overall balance of the quantity of water in the circuit takes into account the condensation of water (0.07 $cm^3$/h, according to the above example) and the quantity of ink added into the circuit (with a volume concentration of 0.43% water according to the above example) whereas water is consumed by printed ink.

The evolution of the volume of water in the circuit is given by:

$$V(t+\Delta t)C(t+\Delta t)=V(t)C(t)+Q_{water}\Delta t+Q_{ink}C_0\Delta t-Q_{ink}C(t)\Delta t$$

Or:

$$V(t+\Delta t)C(t+\Delta t)=V(t)C(t)+Q_{water}\Delta t-Q_{ink}(C(t)-C_0)\Delta t$$

where:

V(t) is the total volume in the circuit at time t;

C(t) is the volume concentration of water at time t;

V(t) C(t) is the total volume of water in the circuit at time t;

$Q_{water}$ (resp. $Q_{ink}$) is the water (resp. ink) flow rate.

Assuming that V(t)=V(t+Δt)=V, one can write:

$$\frac{dC}{dt} = \alpha C + \beta$$

with:

$$\alpha = -\frac{Q_{ink}}{V} \text{ and } \beta = \frac{Q_{water} + Q_{ink} * C_0}{V}$$

The solution of this last equation is:

$$C(t) = \left(C_0 + \frac{\beta}{\alpha}\right)e^{\alpha t} - \frac{\beta}{\alpha}$$

Assuming $C(0)=C_0$.

Assuming V=1 l, $C_0$=0.43%, $Q_{ink}$=5 $cm^3$/h and $Q_{water}$=0.07 $cm^3$/h, the curve of FIG. 9A is obtained.

Based on this curve, a water mass concentration of 1% in the ink is obtained after 80 h of printing (which means about 8 days of operation), which is not acceptable by the user of the printing machine in particular for some technical inks.

Of course, the above results can vary, depending on the initial values. But, even if the water flow rate is half (0.03 g/h instead of 0.06 g/h), the upper limit of acceptable water mass concentration will be reached after 200 h, which is also not acceptable by the user.

One solution is to pressurize the printing head, which prevents entry of air from the outside atmosphere into the head. But this increases the evaporation of solvent in the printing head, generates turbulences and disturbs the drops which are deviated from their trajectory.

These problems are amplified in multi-jets print heads, where the pumping rate can reach 60 l (air)/h or more, in which case the water concentration can reach the sustainable values after only some hours of operation.

FIGS. 9A and 9B show the water mass concentration in a circuit of a known printer for a pumping rate of 10 l/h (FIG. 9A) and for a pumping rate of 100 l/h (FIG. 9B); for the lower, resp. upper, pumping rate a water mass concentration of 1% is reached at 100 h, resp. at about 10 h; in other words, the upper limit of acceptable water mass concentration can be reached much faster for a high pumping rate, which makes the problem even more acute.

SUMMARY OF THE INVENTION

The invention first concerns a method for operating a printhead of a continuous inkjet printer, wherein said method comprises:

- producing at least one ink jet in a cavity of said print head,
- electrostatically separating drops or sections of one or more of said jet intended for printing from drops or sections that do not serve for printing,
- exiting or releasing from said cavity drops or sections of ink intended for printing, through a slot open on the outside of the cavity or of the print-head.

In a method according to the invention, the local atmosphere at the inlet and/or at the exit of said outlet slot is dry and cold, and prevents humid air from the atmosphere outside the print head to flow into said print head. A method according to the invention preferably circulates at least one first flow of air, preferably dry and cold air, along at least part of said outlet slot of said cavity or of said printhead, more preferably along at least part of the inlet and/or of the exit of said outlet slot; preferably said at least one first flow of air circulates in a direction perpendicular or essentially perpendicular to at least one jet of ink emitted by said printhead and intended for printing.

Said air preferably has a water vapor pressure lower than the water vapor pressure defined by 100% relative humidity at the coldest temperature in said printer.

The air thus circulated will not condense inside the head and will not add water to the ink. The concentration of water in the ink will therefore remain in a narrow range, for example from 0.5% to 5%.

Said at least one first flow of air circulated along at least part of the outlet slot may comprise dry air (or dry and cold air) that is provided by means for generating dry air from ambient air.

In an embodiment, air extracted from said cavity is recirculated through a recirculation circuit and is injected into the cavity of said print head, said recirculation circuit comprising for example at least one condenser.

In an example, part (for example 50%) of said recirculated air may be circulated along at least part of the slot without being mixed with air of said at least one flow of air (for example dry air that is provided by means for generating dry air from ambient air) which is also for circulation along at least part of the slot, whereas another part, for example 50%, of said recirculated air is injected into said cavity without being circulated along said slot.

In another embodiment, part of said flow of air extracted from said cavity and recirculated through a recirculation circuit is mixed with at least part of said flow which is circulated along at least part of said outlet slot.

For example, part (for example 50%) of said recirculated air may be mixed with at least one flow of air (for example dry and cold air that is provided by means for generating dry air from ambient air) which is for circulation along at least part of the slot, said mixture being then circulated along at least part of the slot, whereas another part, for example 50%, of said recirculated air is injected into said cavity.

The temperature and/or the hygrometry can be measured, for example with at least one temperature and/or at least one hygrometry sensor, inside and/or outside said cavity and/or in a recirculation circuit, for example at the outlet of a condenser of said recirculation circuit, said condenser being for condensing solvent vapors.

The temperature and/or the hygrometry of the air circulated along said at least part of said outlet slot can be estimated and/or calculated and/or regulated so that the water vapor pressure of said air is lower than the water vapor pressure defined by 100% relative humidity at the coldest temperature of said printer.

Said coldest temperature of said printer can be estimated based on a preset temperature belonging to a temperature working range of said printer and/or said water vapor pressure can be estimated based on a temperature working range of said printer and/or on a hygrometry working range of said printer. This is particularly useful when the printer does not have any sensor.

Preferably, said flow of air (circulated along at least part of said outlet slot of said cavity or of said printhead) is at a temperature which is lower than or equal to the coldest temperature inside the printhead and/or inside the recirculation path. In particular, the temperature inside said cavity can be measured—for example with a temperature sensor—and compared with a temperature measured—for example with a temperature sensor—at the outlet of the condenser of a recirculation circuit, in order to confirm that the outlet of the condenser is colder than the cavity.

In a method according to the invention, at least the temperature and the hygrometry can be measured outside said cavity, and at least another temperature is measured in a recirculation circuit, preferably at the outlet of a condenser of said recirculation circuit, the temperature and/or hygrometry of air recirculated by said recirculation circuit and supplied to said print head (for circulation along at least part of said outlet slot of said cavity or of said printhead) being adapted according to said measurements (temperature and hygrometry) outside said cavity and in (temperature) said recirculation circuit.

In a preferred embodiment of a method according to the invention:

- said coldest temperature of the printer is estimated based on a preset temperature belonging to a temperature working range of said printer;
- and/or said water vapor pressure is estimated based on a temperature working range of said printer and/or on a hygrometry working range of said printer.

In order not to interfere with the ink jet(s) emitted by said print head, said flow of air circulates air along at least part of the outlet slot at a speed less than 2 m/s.

In a particular embodiment, said flow of air circulates along at least part of the outlet slot outside of the cavity or of the printhead or between at least part of the outlet slot of the cavity and at least part of an outlet slot of said printhead.

In a particular embodiment, said flow of air is injected into the printhead or into the cavity and circulates inside or outside the head or the cavity along the outlet slot, preferably in a straight direction and/or without deviation, from one side of the cavity or of the printhead with respect to the jet(s) direction (or from one side of the jet(s)) to the other side.

Said flow of air circulates along at least part of the outlet slot, preferably in a straight direction and/or without deviation, from one side of the cavity or of printhead (with respect to the jet(s) direction) until it has passed the slot, and in some embodiments to the other side of the cavity or of printhead. It flows first along said outlet slot and, in some embodiments, can then be deviated, for example by another flow flowing in the opposite direction, in which case both flows form an atmosphere of dry and cold gas at the outlet slot.

More generally, in a method according to the invention, the local atmosphere at the inlet and/or at the exit of said outlet slot is dry and cold, and prevents humid air from the atmosphere outside the print head to flow into said print head. In some embodiments, two flows of air can circulate along the outlet slot, or along at least part of it (or meet at the outlet slot) preferably in a straight direction and/or without deviation, from both sides of the cavity or of printhead (with respect to the jet(s) direction).

The invention also concerns a print head of a binary continuous jet printer comprising:

- a cavity for circulating at least one ink jet,
- means for producing at least one ink jet in said cavity,
- means for electrostatically separating drops or sections of one or more of said jet intended for printing from drops or sections that do not serve for printing,
- a slot, open on the outside of the cavity or of said printhead and enabling the exit of drops or sections of ink intended for printing,
- at least one gutter for recovering drops or sections not intended for printing.

The print head according to the invention comprises, or is connected to, a circuit for forming dry and cold air, at least locally at the inlet and/or at the exit of said outlet slot, in order to prevent humid air from the atmosphere outside the print head to flow into said print head.

Said circuit preferably comprises means for forming or circulating at least one flow of air, preferably dry and cold air, along at least part of said outlet slot of said cavity or of said printhead, preferably in a direction perpendicular or essentially perpendicular to at least one jet of ink emitted by said printhead and intended for printing.

Said circuit can comprise means for generating dry and cold air from ambient air, said dry and cold air being then circulated so as to flow along at least part of said outlet slot.

A printhead according to the invention may comprise means for implementing a method to the invention.

Preferably a printhead according to the invention comprises means to control and/or to regulate the temperature and/or the hygrometry inside at least a portion of said circuit for circulating air along at least part of said slot.

Preferably said temperature and/or hygrometry is controlled and/or regulated such that air in said circuit has a water vapor pressure lower than the water vapor pressure defined by 100% relative humidity at the coldest temperature of said printer.

A print head according to the invention may further comprise a recirculation circuit of air and/or ink not used for printing, said recirculation circuit possibly comprising at least a condenser, air from said recirculation circuit being injected into said cavity of said printhead.

Said circuit for circulating air along at least part of said slot may comprise means for circulating air from said recirculation circuit and air from said means for generating dry air from ambient air, said circuit comprising means for mixing at least part of the air from said recirculation circuit and at least part of the air from said means for generating dry air from ambient air.

A print head according to the invention may comprise means for mixing part (for example 50%) of said recirculated air with air of said circuit for forming or circulating at least one flow of air which is for circulation along at least part of the slot, said mixture being then circulated along at least part of the slot.

A print head according to the invention may comprise means for circulating part (for example 50%) of said recirculated air along at least part of the slot, in parallel to the flow of dry and cold air also circulated along at least part of said slot. The other part, for example 50%, of said recirculated air can be injected into the cavity of said print head (said other part not being circulated along at least part of the slot).

At least one sensor may be implemented to measure the temperature and/or hygrometry inside and/or outside said cavity and/or in a recirculation circuit of air extracted from said cavity or said printhead, for example at the outlet of a condenser of said recirculation circuit.

A sensor can be implemented to measure a temperature inside said cavity, said print head further comprising means for comparing said temperature inside said cavity with a temperature measured at the outlet of the condenser of a recirculation circuit in order to confirm that temperature measured at the outlet of the condenser is colder than in the cavity.

The means which can be implemented to control and/or to regulate the temperature and/or the hygrometry of at least a portion of said circuit for circulating air along said slot may comprise a controller or a computer specially programmed for maintaining air injected into the cavity at a target temperature and/or hygrometry and/or for maintaining the water vapor pressure of air in said circuit lower than the water vapor pressure defined by 100% relative humidity at the coldest temperature of said printer.

For example a print head according to the invention may comprise means for, or programmed for, calculating or estimating or selecting the temperature and/or the hygrometry and/or a water vapor pressure lower than the water vapor pressure defined by 100% relative humidity at the coldest temperature of the printer.

Said temperature and/or hygrometry and/or water vapor pressure can be estimated based on measurements of one or more temperature and/or hygrometry inside and/or outside said cavity or said printhead and/or in a recirculation circuit, for example at the outlet of a condenser of said recirculation circuit, and/or based on one or more temperature and/or hygrometry of a range of a temperature working range and/or hygrometry working range for said printer. Said circuit for circulating air along at least part of said slot comprises means for circulating said air along the outlet slot at a speed preferably less than 2 m/s.

Said circuit can be, or can comprise means, for circulating air along at least part of the outlet slot outside and/or inside the cavity or the printhead.

In a particular embodiment, said head comprises a $1^{st}$ gutter fixed with respect to the head, a $2^{nd}$ gutter movable with respect to the head, said $2^{nd}$ gutter being located between said cavity and a cover comprising an outlet slot, said circuit comprising means for circulating said air between said $2^{nd}$ gutter and said cover.

In a further particular embodiment, said circuit is for circulating said air inside or outside the head or the cavity along at least part of the outlet slot, preferably in a straight direction and/or without deviation, from one side of the cavity or of the printhead with respect to the jet(s) direction (or from one side of the jet(s)) to the other side.

In some embodiments, said circuit is for circulating said flow of air along at least part of the outlet slot, preferably in a straight direction and/or without deviation, from one side of the cavity or of printhead (with respect to the jet(s) direction) until it has passed the slot, and in some embodiments to the other side of the cavity or of printhead.

In some embodiments, said circuit is for circulating two flows of air, each along at least part of the outlet slot, preferably in a straight direction and/or without deviation, from both sides of the cavity or of printhead (with respect to the jet(s) direction).

BRIEF DESCRIPTION OF THE DRAWINGS

FIGS. 4A1-4D are other embodiments of a device according to the invention;

DETAILED DESCRIPTION OF EMBODIMENTS OF THE INVENTION

Figure 1:
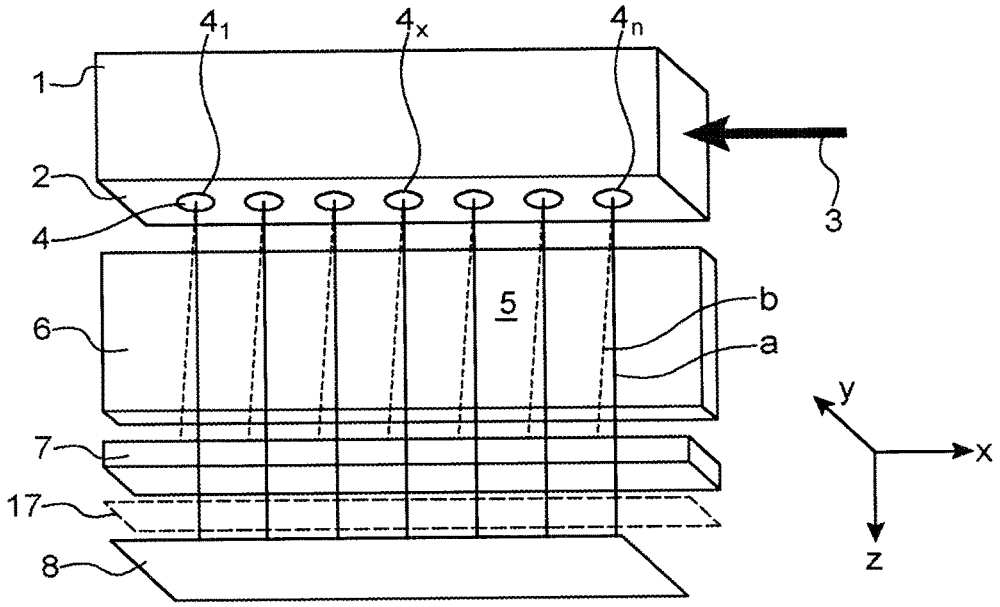
FIG. 1 is an example of a print head to which the invention can be applied.

FIG. 1 is an example of a print head to which the invention can be applied.

The head shown includes a drop generator 11. An integer number n of nozzles 4 are aligned on a nozzle plate 2 along an X axis, between a first nozzle $\mathbf{4}_1$ and a last nozzle $\mathbf{4}_n$.

The first and the last nozzles ($\mathbf{4}_1$, $\mathbf{4}n$) are the nozzles with the greatest distance between them.

Each nozzle has a jet emission axis parallel to a Z direction or axis (located in the plane of FIG. 1), perpendicular to the nozzle plate and to the X axis mentioned above. A third axis, Y, is perpendicular to each of the X and Z axes, the two X and Z axes extending in the plane of FIG. 2.

Each nozzle is in hydraulic communication with a pressurized stimulation chamber. The drop generator comprises one stimulation chamber for each nozzle. Each chamber is provided with an actuator, for example a piezo-electric crystal. An example design of a stimulation chamber is described in document U.S. Pat. No. 7,192,121.

There are sort means or a sort module 6 downstream from the nozzle plate, that will be used to separate drops used for printing from drops or jet segments not used for printing. Said means or sort module 6 may comprise one or more electrodes, which can be formed against, or in, a wall 10 which delimits the cavity in which the jets are produced. At least one electrode may be flush with the surface of the wall in question. Thus the drops or sections that do not serve for printing are deviated by electrostatic effect of at least one electrode on the drops.

This separation or deviation may be done without charging of the deviated drops or the deviated sections of jets, as explained in the document FR2906755 or U.S. Pat. No. 8,162,450. In other words, in such case, the cavity does not contain an electrode for charging drops or sections of ink. The ink which is deviated to the gutter is thus not charged.

Figure 2:
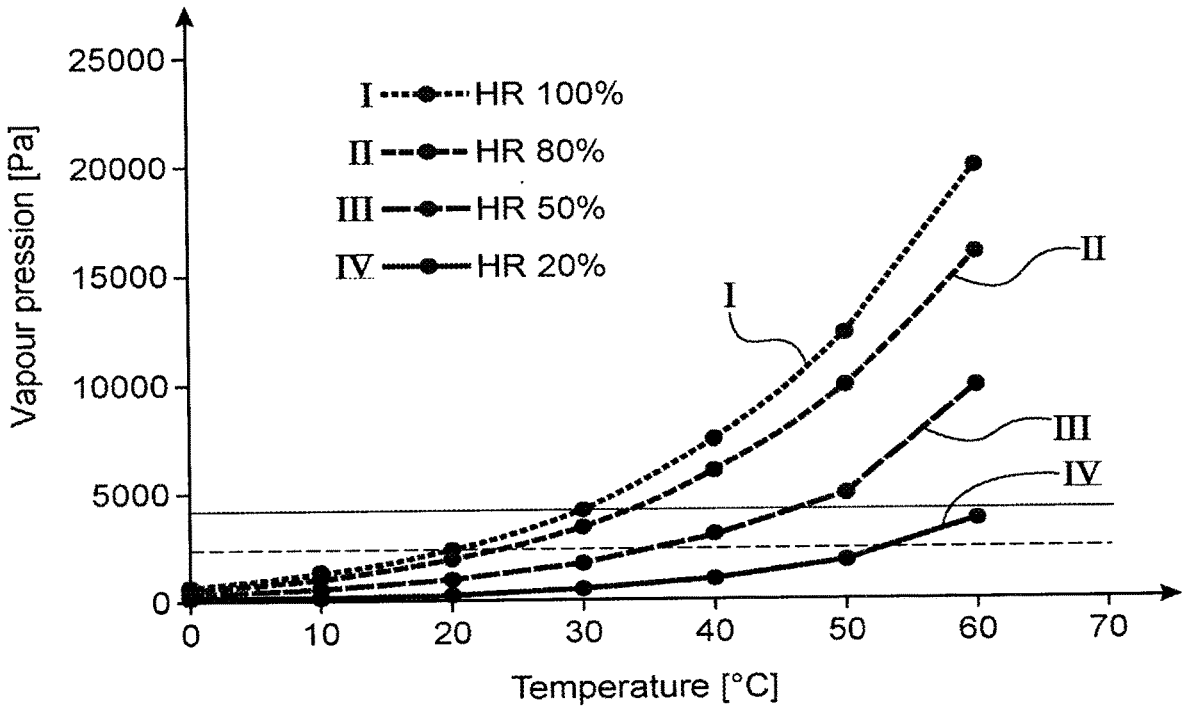
FIG. 2 represents the vapor pressure of water as a function of the temperature, for different levels of hygrometry.

More precisely, drops or jet segments emitted by a nozzle and that will be used for printing follow a trajectory a along the Z axis of the nozzle, and then strike a print support 8, after having passed through the outlet slot 17 (shown in dashed lines in FIG. 2). The slot is open to the outside of the cavity and ink drops to be printed exit through it; it is parallel to the X direction of nozzle alignment, the Z direction axes of the nozzles passing through this slot, that is on the face opposite the nozzle plate 2. Its length is equal to at least the distance between the first and the last nozzle.

Drops or jet segments emitted by a nozzle and not intended for printing, are deviated by means 6 (they follow a trajectory such as trajectory b) and are recovered in a gutter 7 and then recycled. The length of the gutter along the X direction is equal to at least the distance between the first and the last nozzle.

For example, document U.S. Pat. No. 8,540,350 (FR 2 952 851) that describes a method of avoiding crosstalk between jets from nozzles adjacent to each other, could be referred to particularly for information about the formation of jets and breaking the jets to form drops, and about the deviation of drops. Reference could also be made to prior art described in U.S. Pat. No. 7,192,121 (FR 2 851 495) describing jet breaking positions depending on whether a drop formed by breaking the jet will or will not strike the print support.

In the present application, the term "cavity" designates the zone of space in which ink flows between the nozzle plate 2 and the outlet slot 17 (or the lower wall which contains said slot) of drops intended for printing or between the nozzle plate and the recovery gutter. The nozzle plate 2 in fact forms an upper wall of the cavity. Laterally, the cavity is delimited by lateral walls (see walls 9, 10 on FIGS. 3A-3D, 4A, 4B), substantially parallel to the curtain of jets constituted by the different jets emitted by the nozzles. One of these walls has already been evoked above, in relation with a jet deviation electrode.

The curves of FIG. 2 show the evolution of the vapor pressure of water as a function of the temperature, for different levels of hygrometry; in order to avoid condensation, the vapor pressure for a given temperature is preferably selected under curve I.

If a print head is operated in an atmosphere at 30° C. the black horizontal line gives the water vapor saturation pressure corresponding to the saturation vapor pressure at 30° C.

For example, if a print head is operated in an atmosphere at 30° C., air inside the print head:

- having a water vapor pressure less than about 4500 Pa will not condense;
- at a temperature less than 30° C. will not condense, whatever its relative humidity;
- at a temperature higher than 30° C. could condense or not depending on its relative humidity; it does not condense if its water vapor saturation pressure is less than the water vapor saturation pressure defined by 100% at the coldest temperature (which is 30° C. in this case).

If the same print head is connected to a recirculation circuit which comprises a condenser, the temperature at which outset being for example 20° C., the dotted horizontal line gives the water vapor saturation pressure corresponding to the saturation pressure at 20° C.

For the same print head operated in an atmosphere at 30° C., but with a condenser with an outset temperature of 20° C., air inside the print head:

having a water vapor pressure less than about 2500 Pa will not condense; in other words, air at the temperature T and with a relative humidity HR will not condense, if the point identified by coordinates (T, HR) in the plane of FIG. 2 is located below the dotted horizontal line (corresponding to 2500 Pa);

air at a temperature less than 20° C. will not condense, whatever its relative humidity;

air at a temperature of 30° C. will not condense, if its relative humidity is less than 54.7%;

more generally, air having a water vapor pressure lower than the water vapor pressure defined by 100% relative humidity at the coldest temperature of the printer or of the system will not condense.

Based on curves like those of FIG. 2, and in order to avoid undesirable water condensation, air injected into the print head (respectively into a system including a print head and a recirculation circuit which sucks air and ink from the gutter of the cavity, extracts solvent from the air and injects the air (after solvent extraction) into the print head), preferably has a temperature and hygrometry providing water vapor pressure lower than the water vapor pressure defined by 100% relative humidity at the coldest temperature in the print head (respectively lower than the water vapor pressure defined by 100% relative humidity at the coldest temperature in the system (print head and recirculation circuit))).

Alternatively, it is possible to implement a temperature sensor and/or a hygrometry sensor, which may help in selecting proper relative humidity and temperature of air injected into the print head.

According to a first example, a system includes a print head and a recirculation circuit which comprises a condenser. A first temperature sensor is implemented and located at the outlet of said condenser. The value ($T_1$) measured by this first sensor is considered to be the lowest temperature in the whole system. A second sensor, measuring temperature ($T_2$) and hygrometry is located outside the print head, for example on a cover of the print head. Air which must be injected into the print head (and which is pumped from the atmosphere outside the print head) thus has a water vapor pressure ($VP_2$) given by the temperature $T_2$ and by the hygrometry measured by said second sensor. A target vapor pressure ($VP_1$) corresponds to 100% humidity at temperature $T_1$ measured by said first sensor (located in said recirculation circuit). So, air has to be dried and/or cooled to exhibit vapor pressure lower than $VP_1$.

If, for example, the second sensor measures $T_2$=30° C. and a hygrometry RH=90% (which corresponds to a water vapor pressure equal to 3780 Pa ($VP_2$)) and the first sensor measures $T_1$=20° C., which corresponds to 2300 Pa ($VP_1$), the system will have to transform air having a vapor pressure $VP_2$ into air having a vapor pressure $VP<VP_1$; for example air initially at 30° C. and having RH=90% must be transformed, for example by a membrane air dryer and/or a condenser, into air at 20° C. and RH=50%. It has to be noted that, without the information concerning the hygrometry RH given by the outside sensor, the assumption that the hygrometry RH=100% has to be made.

According to a second example, a system includes a print head and a recirculation circuit which comprises a condenser. A temperature sensor is implemented and located at the outlet of said condenser. The value ($T_1$) measured by this sensor is considered to be the lowest of the whole system. As there is no sensor to measure the temperature and the hygrometry outside the print head, the maximum value given by the printer datasheet is considered, for example 40° C. and RH=90% (or more generally, it can be a set of values (T, HR) memorized in the system, for example in the controller, and which is taken as a set of reference values for both the temperature and the relative humidity). It is assumed that air which must be injected into the print head (and which is pumped from the atmosphere outside the print head) thus has a water vapor pressure ($VP_2$) at the maximum temperature/hygrometry given by said datasheet (more generally, a water vapor pressure ($VP_2$) given by said set of values (T, HR) memorized in the system). Target vapor pressure ($VP_1$) value is given by 100% humidity at the temperature provided by said sensor located in said recirculation circuit. So, air has to be dried and/or cooled to exhibit vapor pressure lower than $VP_1$.

For example, 40° C./90% RH corresponds to a water vapor pressure equal to 6660 Pa (VP2). The sensor located at the outlet of the condenser measures $T_1$=20° C. corresponding to 2300 Pa ($VP_1$). The system thus has to transform, for example by a membrane air dryer and/or a condenser, air at $VP_2$ into air at $VP<VP_1$, for example into air at 20° C. and 50% RH.

According to a third example, a system includes a print head and a recirculation circuit which comprises a condenser, but no sensor is implemented: no information can be measured concerning the temperature and/or the hygrometry outside the print head or the temperature in the recirculation circuit. We have to manage the whole range of temperature/hygrometry given for example by the datasheet of the printer, for example a temperature range of 10° C.-40° C. and a hygrometry range of 10%-90% RH (or more generally, it can be a set of values (T, HR) or a range of temperatures T and a range of hygrometry HR memorized in the system, for example in the controller, and which is taken as a set of reference values or a set of reference of ranges for both the temperature and the relative humidity). If the temperature of the recirculation circuit can be at maximum 10° C. colder than temperature outside print head, air injected into the print head should exhibit a vapor pressure lower than the vapor pressure at T=0° C. and HR=100%; this vapor pressure is $VP_2$=600 Pa.

At any rate a printer according to the invention can comprise means, for example a membrane air drier and/or a condenser, to transform air (taken from ambient air) which is to be injected into the print head and/or into its cavity. It is possible to control said means, for example by the controller of the printer; in particular:

the pressure difference between both sides of the membrane, and/or the power of a condenser, can be controlled in order to adapt the efficiency of the membrane air drier and/or of the condenser according to the needs and depending on the thermodynamic conditions (temperature and/or hygrometry).

FIGS. 3A-3D are section views of different examples of printing head (multi-jet or CIJ) to implement the invention.

In these figure references identical to those of FIG. 1 designate identical technical elements.

Aspects common to these different embodiments, and to the embodiments of FIGS. 4A1-4D, will firstly be explained. These sections are taken along a plane parallel to the plane YZ, and containing the axis Z of a nozzle 4. The representation of each section keeps the same shape over the distance going, along the direction X (perpendicular to the plane of each of the FIGS. 3A-3B), from the first nozzle $4_1$ to the final nozzle $4_n$. In these figures, only the cavity 5 in which the jets circulate is represented.

$P_0$ designates the plane that goes through the nozzle $4x$ and which is parallel to the plane XZ. This plane is perpendicular to each of FIGS. 3A-3C and goes through all the nozzles, which are aligned along X. It also goes through the slot 17. A plot of this plane is represented in FIGS. 3A-3D in broken lines.

The upper part of the cavity is delimited by the 1st wall 2, also called upper wall, which also forms, or comprises, the nozzle plate or comprises nozzles. The lower part of the cavity is delimited by a 2nd wall 21, also called lower wall, traversed by the slot 17, and by a part of the gutter 7. Walls 9 and 10 limit the lateral extension, along the axis Y.

The cavity comprises in addition, on one side of the plane $P_0$, a lateral wall 9, preferably parallel to the plane $P_0$ and contiguous with the nozzle plate 2. The wall 10, situated on the other side of the plane $P_0$, faces the wall 9. The cavity is thus delimited, on either side of the plane $P_0$, by these 2 walls 9 and 10. By convention, the side of the plane $P_0$ where the wall 10 and the gutter 7 are located is called first side of this plane, the other side (where the wall 9 is located), is called second side.

The wall 10 has ends, along the direction X, which are contiguous with the nozzle plate 2. In the part which is close to the nozzle plate 2 and over a length that is, preferably, slightly greater than the distance between the first $4_1$ and the final nozzle $4_n$, this wall may comprise a slot 14, which will make it possible to suck up ink that is deposited on the nozzle plate or in its vicinity.

At the bottom of this wall 10 is located the inlet slot of the recovery gutter 7 to make it possible to recover drops that are deviated in order that they do not pass through the slot 17.

The gutter may be placed in hydraulic communication with the slot 14, by means of a conduit 13 that emerges in, or is in connection with, the gutter and which is situated to the rear of the wall 10 with respect to the plane $P_0$.

The means 6 for selecting and deviating drops not intended for printing are flush on the wall 10 or are attached to said wall. These means mainly comprise electrodes. They are intended to be connected to powering up means, not represented in the figure.

Preferably, the distance between the wall 10 and the plane $P_0$, measured along the direction Y, perpendicular to the plane $P_0$, is, going from the plate 2, firstly constant; this corresponds to a 1st part $10_1$ of the wall 10, which is substantially parallel to $P_0$.

Then, in a particular embodiment, in a second part $10_2$, further from the plate 2 than the 1st part $10_1$, from a point $6_1$ of incline of the wall 10, the distance between the wall 10 and the plane $P_0$ increases with the moving away from the nozzle plate.

In this example, the wall 10 is close to the plane $P_0$, and parallel thereto, in a 1st part of the cavity situated in the vicinity of the nozzles $4_x$, in the place where the path of the drops is hardly modified, even when drops situated more downstream on this path are deviated to enter into the recovery gutter 7.

This is what may be seen in FIGS. 3A-3D, where a path of drops is deviated to the gutter 7: the upper part of the jet is not, or is only very slightly, deviated, whereas, from a point 61 of inclination of the wall 10, the jet moves away more and more, almost linearly, from the plane $P_0$. This could be termed a ballistic path of the jet downstream of the electrostatic field area.

A lower part of the wall 10 and a wall 12, situated to the rear of the wall 10 with respect to the plane $P_0$, defines, facing a wall 11, a conduit, or gutter 7 for evacuating drops that will not be used for printing.

The walls 10 and 12 are, preferably, contiguous with each other, the reference 18 designating the junction line of these two walls 10 and 12; this line is parallel, or substantially parallel, to the direction X. They form an upper wall of the gutter.

The wall 11 forms a lower wall of the gutter. It comprises a 1st part $11_1$, the most upstream in the sense of circulation of the drops in the conduit 7 and a second part $11_2$, the most downstream.

The potential conduit 13 may emerge in the upper wall 12 and hydraulically connect the recovery gutter 7 to a conduit 141 hydraulically connected to the slot 14.

The reference 28 designates a junction line of the parts $11_1$ and $11_2$ of the wall 11; this line is parallel, or substantially parallel, to the direction X and to the line 18.

The part $11_1$ the most upstream, at the inlet of the conduit 7 of the lower wall 11, terminates by an end part 15, which, advantageously, constitutes its apex (or summit). It is the point of the surface 11 that is the closest to the plane $P_0$.

Preferably, this apex 15 (which is the point the most upstream of the gutter) is in a same plane as wall 16 that is parallel to the plane $P_0$ and which forms one of the walls surrounding or delimiting the outlet slot 17. In other words, the point the most upstream of the gutter is directly in line with the outlet slot 17 of the cavity. This makes it possible to optimise the recovery of drops: thanks to this configuration, any drop deviated, even slightly, will be recovered by the gutter.

Figure 3A:
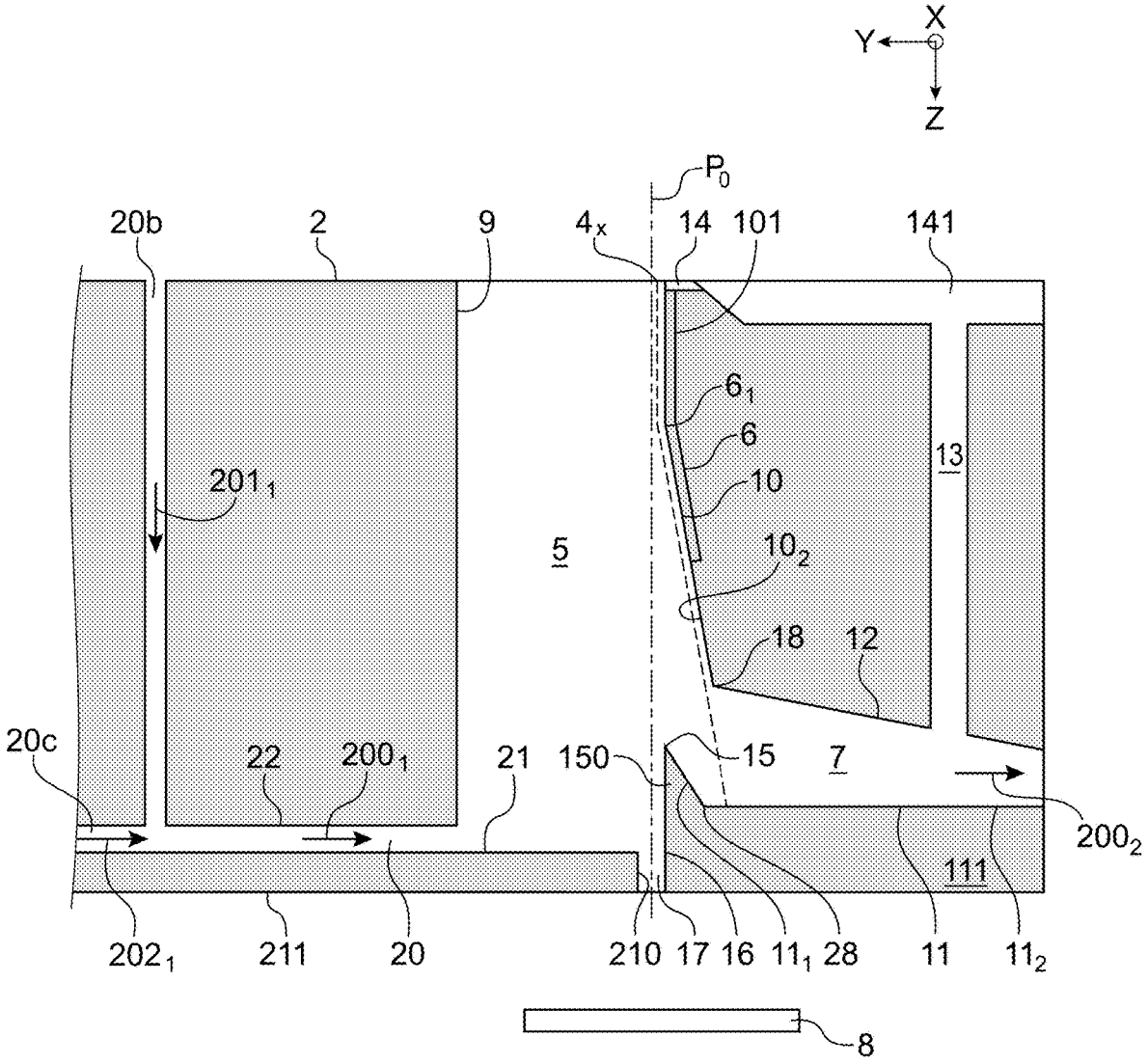
FIGS. 3A-3E are different embodiments of a device according to the invention.

The slot 17 constitutes an opening of the cavity 5 through which pass drops intended for printing. The intersection of plane $P_0$ with the plane of FIG. 3A is a materialization of the axis of the nozzle $4_x$. This axis goes through the centre of the slot 17.

Another wall of the cavity is constituted by the wall 21: it is substantially parallel to the plate 2, but the furthest away therefrom in the cavity 5. In other words, it is situated on the side of the outlet slot 17. An end of this wall may form an inlet edge of the slot 17, facing the wall 16 already mentioned above.

A wall 210, substantially perpendicular to the wall 21, delimits, with the wall 16, the outlet slot 17: the drops are going to circulate between these 2 walls, before exiting the slot 17 and being crushed on the printing support 8.

Finally, the reference 211 designates the exterior surface of the cavity, into which the outlet of the slot 17 emerges.

An example of operation of these cavities is as follows. A continuous ink jet is emitted by the print head. The deflection of this jet is commanded by electrodes 6 to create, as a function of the pattern to print and the position of the support 8, drops intended or not for printing.

Drops intended for printing move along the axis Z (in the plane $P_0$) and pass through the slot 17.

Drops not intended for printing are deviated from the axis Z (or from the plane $P_0$), and along a trajectory that brings them to strike the lower wall 11 of the gutter 7.

Since the gutter is connected to a vacuum source, the ink of these drops, which have stricken the wall 11, exit, with air, the cavity 5 via the gutter.

Furthermore, the conduit 13 and the slot 14 can maintain a slight low pressure at the level of the nozzle plate 2. This low pressure makes it possible to absorb ink which, by capillarity, is deposited on the nozzle plate 2.

In FIG. 3A is represented a particular aspect of an embodiment of the invention.

The reference 7 designates a recovery gutter, for example of the type known from the prior art according to the teaching of document WO 2012/038520. Pumping means (not represented in the figure) may be connected to the gutter to suck up ink that enters into the latter.

A $1^{st}$ lateral conduit 20 enables the cavity 5 to be placed in communication with a source of gas, preferably air, not represented.

One of the walls of this conduit 20 is the wall 21; a $2^{nd}$ wall 22, which faces the $1^{st}$ wall and which is parallel to it, re-joins the wall 9, in which an opening enables the conduit to emerge in the cavity 5. The conduit 20 is thus arranged laterally, at the bottom of the cavity, that is to say, along the axis Z, on the side opposite to the plate 2. It is also arranged, laterally, on the side opposite to that in which the gutter 7 emerges. This conduit 20 is going to make it possible to make circulate, in the direction of the cavity 5 and substantially parallel to the wall 21, a flow of air or gas, as represented by the arrow $\mathbf{200}_1$. This flow of air or gas is injected into the print head, for example with help of a pump, preferably so that the air sweeps (circulates in) a portion of the print head just along the outlet slot 17, or along at least part of the inlet of said outlet slot, in order to limit the exchange of from/toward the outside of the head and the contact between the injected air and the jet(s). Said flow of air circulates inside the head along the outlet slot, preferably in a straight direction, without deviation, from one side of the cavity (or from the jet(s)) to the other side.

Said flow of air has a temperature and/or a hygrometry such that it does not condensate inside the print head; preferably it is drier and colder than air in said cavity.

Thus additional air is injected into the cavity, said air not condensing in the head.

In an embodiment air is injected, for example laterally (in particular, it can be a vertical and/or horizontal injection as shown by arrows $\mathbf{201}_1$ and $\mathbf{202}_1$ on FIGS. 3A-3D) through one or more ducts 20*b*, 20*c* made in the head and then flows directly into conduit 20 or is deviated to flow into conduit 20 to sweep the lower portion of the head. Said duct(s) can be connected to a pump to inject air into it/them.

In the embodiments of FIG. 3A-3D or 4A1-4D air is circulated so as not to disturb the trajectory of the ink jet emitted by said print head. In particular, the flow of air is preferably kept at a value less than 2-3 m/s, for example about 1 m/s or less. This air comprises:

- preferably dry and cold air, obtained for example from ambient air flowing through a condenser and/or a membrane air drier;
- and/or air recirculated from the print head.

Figure 3B:
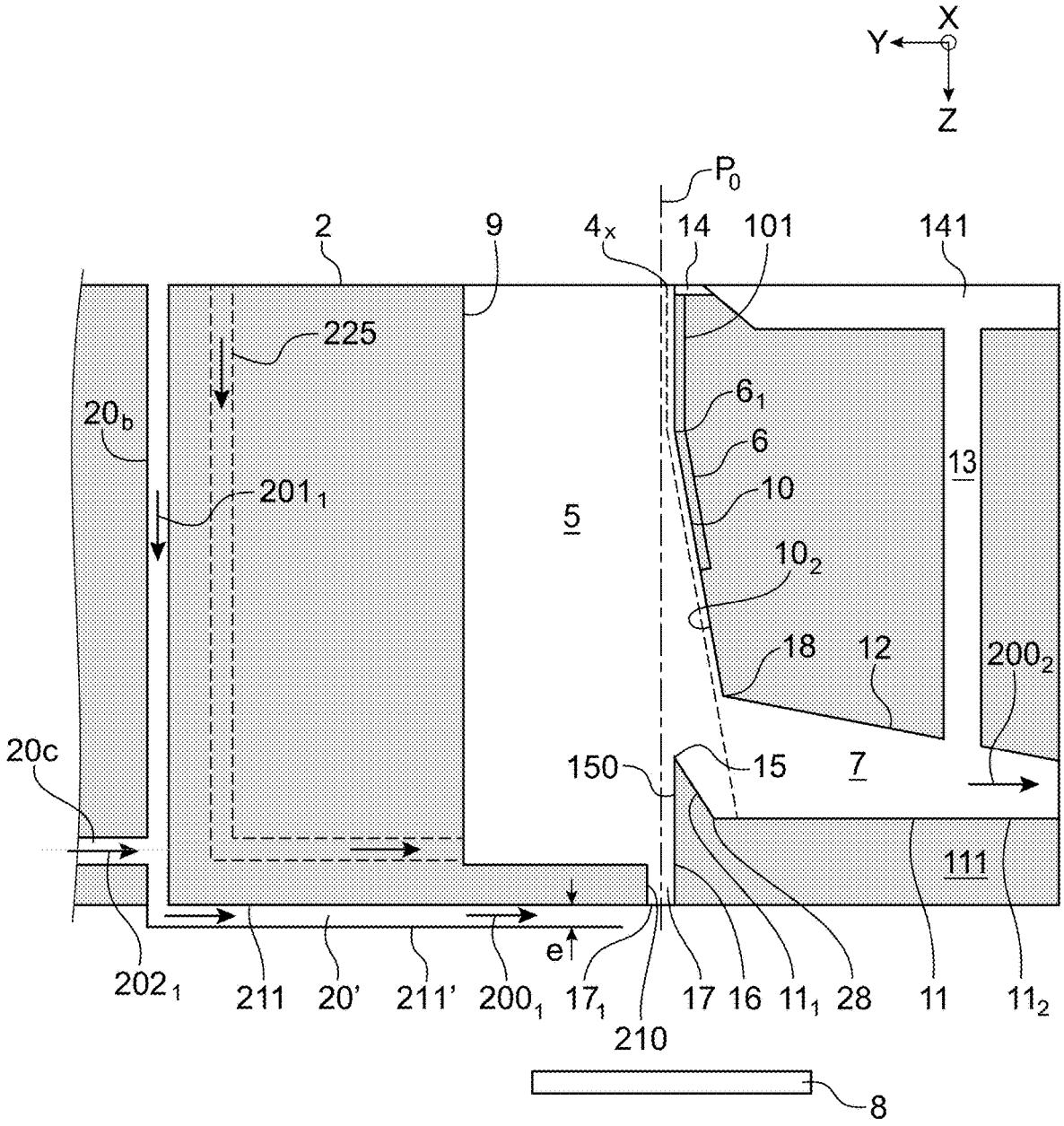

FIG. 3B is another example of printing head (multi-jet or CIJ) to implement the invention.

The head is identical to the print head of FIG. 3A but the flow of dry and cold air is circulated outside the cavity, just below surface 211 so that the air flows just below the outlet slot 17 (along at least part of the exit $\mathbf{17}_1$ of said outlet slot), thus also limiting the exchange of air from/toward the outside of the cavity and the contact between the injected air and the jet(s). Air flows for example along a conduit 20', a wall 211' of this conduit facing wall 211.

The thickness e of this flow of air sweeping the outside of the head is for example equal to 2 mm or 3 mm or more generally between 1 mm and 5 mm. e is also the distance between walls 211 and 211';

This configuration increases the distance, preferably limited to less than 20 or 30 mm, between the nozzle plate 2 and the substrate 8 on which printing is performed.

Figure 3C:
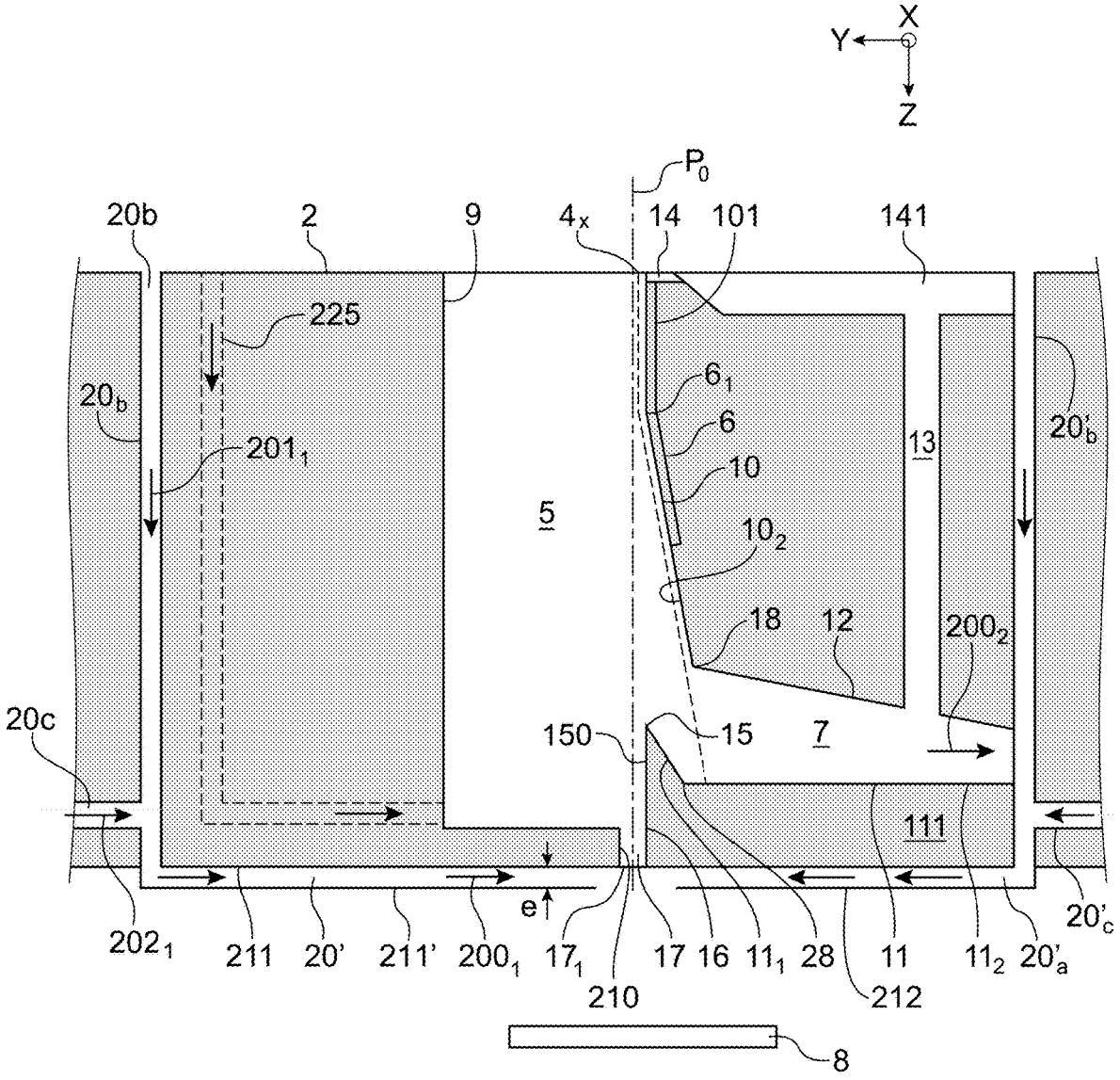

Alternatively, as illustrated on FIG. 3C, a $2^{nd}$ injection of fluid symmetrical to the injection made through the $1^{st}$ conduct 20' can be performed through a $2^{nd}$ conduct 20'*a*. The $2^{nd}$ flow of dry and cold air is circulated in a direction opposite to the flow circulation inside conduct 20', just below surface 211 so that the air of this $2^{nd}$ flow also flows just below or along part of the outlet slot 17 (along at least part of the exit $\mathbf{17}_1$ of said outlet slot), thus also limiting the exchange of air from/toward the outside of the cavity and the contact between the injected air and the jet(s). Air flows for example along a conduit 20'*a*, a wall 212 of this conduit facing wall 211.

As illustrated on FIG. 3D, an additional element, for example a plate 21, can be added to the bottom of a print head so as to implement an air flow circulating outside the cavity, just below surface 211 so that the air flows just below or along the outlet slot 17 or along part of it (or along at least part of the exit $\mathbf{17}_1$ of said outlet slot).

Said additional plate 21 comprises a frame comprising a central hole 213 adapted to receive at least part of a printing head. Lateral thicker connecting portions $\mathbf{21}_1$ and $\mathbf{21}_2$ comprise connection means, for connecting one or two ducts $\mathbf{20}b_1$, $\mathbf{20'}b_1$ to inject air.

For example each of the connecting portions $\mathbf{21}_1$ and $\mathbf{21}_2$ comprises connection means for a hose barb (or fir tree) connection, made of a tube with a diameter slightly higher than that of inside the hose, this tube being equipped with concentric barbs having a low angle in the insertion direction of the hose and a sharp angle in the extraction direction, the hose is thereby retained during an extraction.

The cover comprises inner ducts $\mathbf{20'}_1$, $\mathbf{20'}_2$ for circulating the air from the lateral injection duct(s) to a central opening 217 which faces the outlet slot 17 of the cavity when the print head is positioned in the hole 213.

Figure 3D:
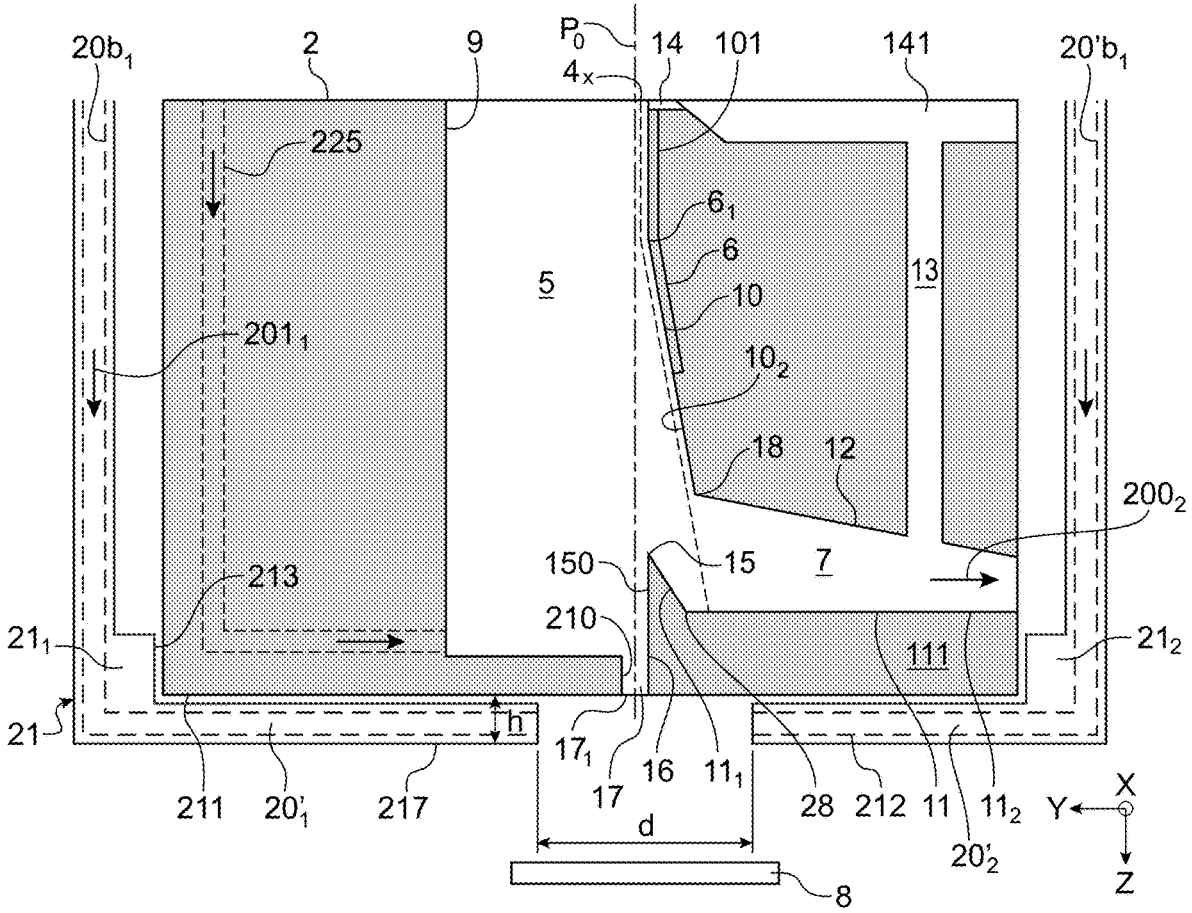
Figure 3E:
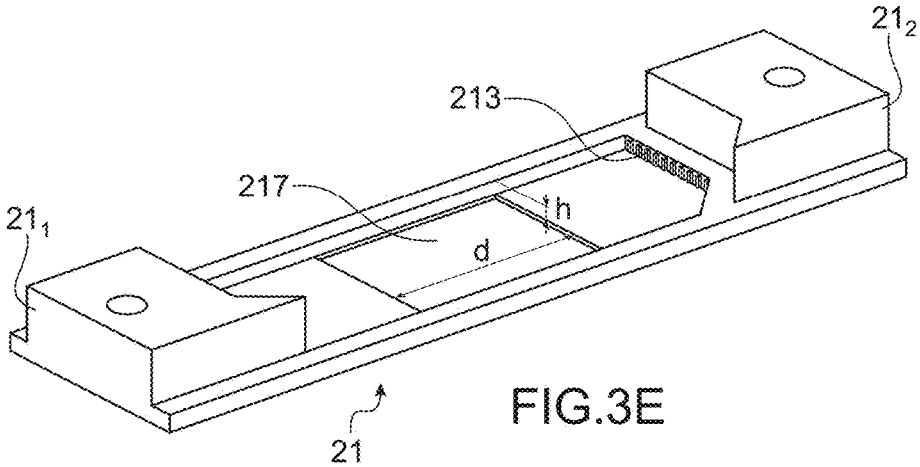

FIG. 3E, shows a perspective view of said additional plate 21, with the lateral thicker connecting portions $\mathbf{21}_1$ and $\mathbf{21}_2$. The height h (FIGS. 3D, 3E) is for example between 1 mm and 3 mm, and the width d (FIG. 3D) is for example between 5 mm and 10 mm.

As illustrated on the embodiment of FIG. 3A, but also in those of FIGS. 3B-3D, a further duct or conduit 225 can be implemented in the print head to inject a $2^{nd}$ flow of air into the cavity 5 of the print head. This $2^{nd}$ flow of air is preferably for "feeding" the jet or the jets curtain ("feeding" meaning, more precisely, replacing the air which is sucked by the gutter); the pressure effect (by the injected gas) can be made more or less equal to, or is to compensate more or less, the suction effect by the gutter 7. This gaseous flow does not bring about any perturbation of the jet(s). Preferably:

- this $2^{nd}$ flow of air is or comprises air recirculated from the print head;
- while air injected through ducts 20' (FIGS. 3B, 3C) and/or 20'*a* (FIG. 3C) or $\mathbf{20'}_1$, $\mathbf{20'}_2$ (FIG. 3D) is or comprises dry air, obtained for example from ambient air flowing through a condenser and/or a membrane air drier.

In the embodiments of FIGS. 3A-3E, air is injected perpendicularly to the direction of slot 17. In a variant of any of these embodiments it can be injected along a direction parallel to the slot 17.

FIGS. 4A1-4D show another example of printing head (multi-jet or CIJ) to implement the invention.

On the figures references identical to those of the preceding figures designate identical technical elements (electrode(s) 6, $1^{st}$ gutter 7, outlet slot 17).

The head of FIGS. 4A1-4D comprises a $1^{st}$, fixed, recovery gutter and a $2^{nd}$, movable, for example sliding, recovery gutter 70, located between said surface 211 and a cover 215. Said cover forms a cavity 213*a* under surface 211 and has an outlet slot 219 aligned with the outlet slot 17 so that a jet intended for printing flows first through outlet slot 17 and then through outlet slot 219.

A flow of dry and/or cold air is injected into the print head, for example from a lateral side of the head, and then this air is oriented so as to circulate in the lower part, under the $2^{nd}$ gutter so that the air is directed just above or along the outlet slot 219, or of at least part of it (or along at least part of the inlet of said outlet slot), with the advantages explained above. In the open position of the $2^{nd}$ gutter (see below), the air is also directed just below or along the outlet slot 17, or of at least part of it (or along at least part of the exit $\mathbf{17}_1$ of said outlet slot).

Figure 4B:
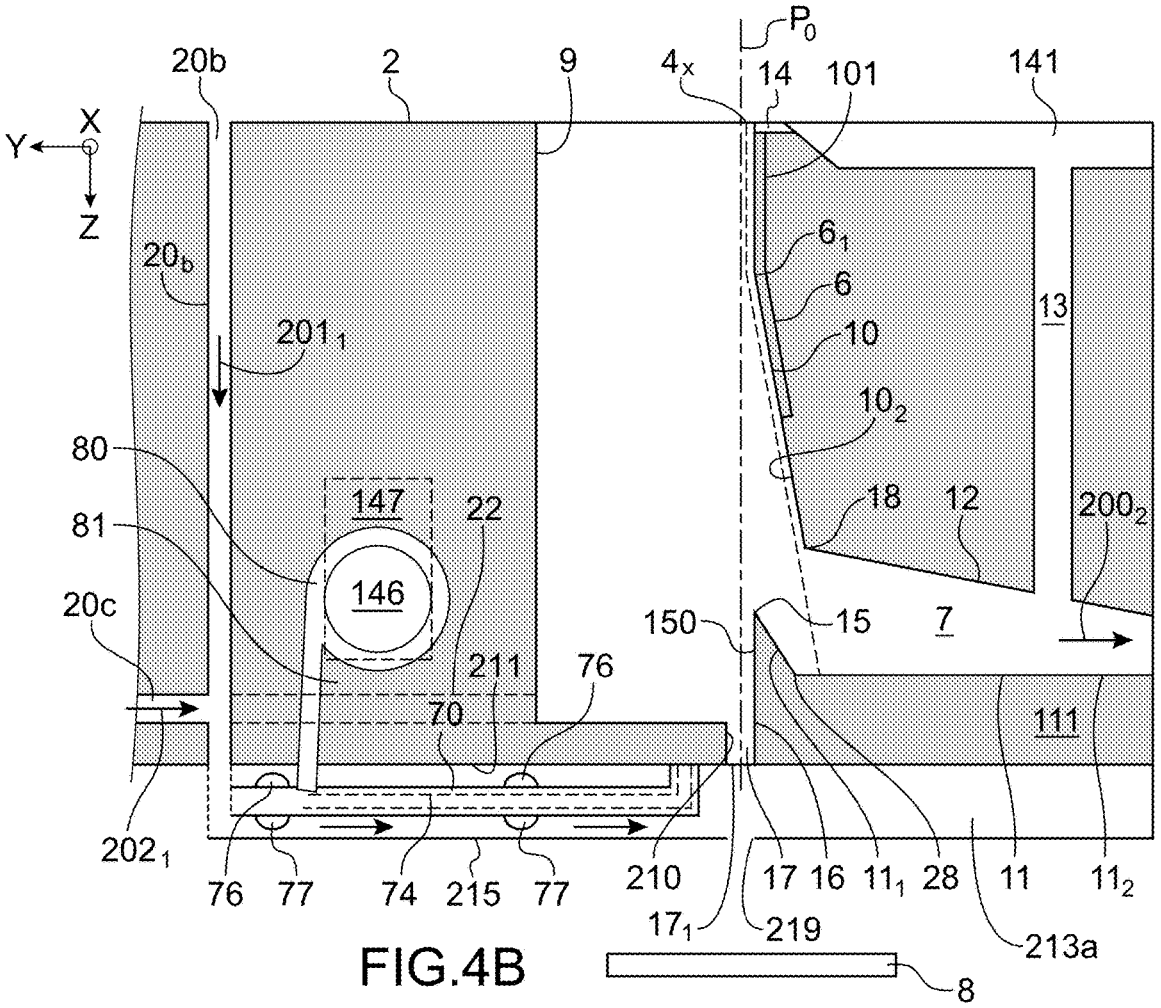

Means are implemented to move this $2^{nd}$ gutter, for example in translation (according to a direction approximately perpendicular to the direction z of flow of the jets in the cavity), between a closed position (as on FIGS. 4A1-4A3 and 4C, 4D), in which its inlet slot 71 is in the continuation of the outlet slot 17 of the cavity, and an open position (as on FIG. 4B), in which the outlet slot 17 of the cavity is free. The $2^{nd}$ gutter may be moved in translation in one direction, until it is closed, then in the opposite direction, from the closed position to the open position. For example a motor 147 (located in the print head), through transmission means, may move the $2^{nd}$ gutter in both directions. Reference 146 on FIGS. 4A1-4D is a transmission axis of the motor (the transmission means comprising further transmission elements). In a particular embodiment return means, for example a spring 80 (FIGS. 4A1-4B, 4D), keep the $2^{nd}$ gutter in one of the closed or open positions; for example, said spring is pre-tensioned and keeps the $2^{nd}$ gutter in the open position (FIG. 4B). This spring can be wound on an axis 146, for example the transmission axis of the motor, an end 81 of this spring being linked with the $2^{nd}$ gutter (as shown on FIGS. 4A1-4D).

In the closed position (as on FIGS. 4A1-4A3, 4D), the inlet slot 71 of the $2^{nd}$ gutter, is against the outside surface 211 of the cavity, so that the inlet slot 71 is in the continuation of the outlet slot 17 of the cavity; preferably, the $2^{nd}$ gutter comprises sealing means (not shown on the FIGS. 4A1-4B, 4D) around slot 71 so that a liquid cannot flow between the outside surface 211 and the $2^{nd}$ gutter; for example it comprises one or more joints which bear against said outside surface 211, close to the outlet slot 17 of the cavity.

This $2^{nd}$ gutter may recover, upon starting the print head, both the initial solvent then the curtain of ink jets.

The $2^{nd}$ gutter can be connected to suction means, for example a pump, through a suction channel 74; preferably, suction means of the $2^{nd}$ gutter are the same as those of the $1^{st}$ gutter, for example a common pump. One or more solenoid valve(s) allows individual activation of each of the gutters. The $2^{nd}$ gutter, when closed (as on FIGS. 4A1-4A3 and 4C, 4D), also forms means for suction of cleaning solvent that otherwise would flow outside the cavity.

The $2^{nd}$ gutter may be guided in translation by guiding means 76, for example studs, which guide the gutter when it is sliding against the outside surface 211 of the cavity. Other guiding means 77, for example studs, located under the $2^{nd}$ gutter, guide the $2^{nd}$ gutter when it is sliding against the inside surface of a cover 215. Laterally, the $2^{nd}$ gutter can be guided in translation by further guiding means, for example studs, which slide against lateral walls, for example of the cover 215, the gutter moving along said lateral walls between its open and its closed positions.

In an embodiment air is injected laterally (for example vertically and/or horizontally as shown by arrows $\mathbf{201}_1$ and $\mathbf{202}_1$ on FIGS. 4A1-4A3 and 4B) through one or more ducts 20*b*, 20*c* made in the head and then flows under the $2^{nd}$ gutter for example between the $2^{nd}$ gutter and the cover 213 (see arrow $\mathbf{200}_1$ on FIGS. 4A1-4C) to sweep the lower portion of the head. Said duct(s) can be connected to a pump to inject air into it/them. The air thus injected flows along the outlet slot 219 and remains for a certain time in the cavity 213*a* between the lower portion of the head and the cover 215.

A further duct 223, similar to the duct 22 of FIG. 3A, can be added to inject air, for example a mixture of air coming from both ducts 20*b*, 20*c* directly inside the cavity.

In a variant (FIG. 4A2), an extra duct or conduit 225 can be implemented in the print head to inject a $2^{nd}$ flow of air into the cavity of the print head.

In a further variant (FIG. 4A3), said extra duct or conduit 225 is connected to duct 20*b* by a duct 227 so that a $2^{nd}$ flow of air can be injected through duct 225, part of said $2^{nd}$ flow being mixed with the flow injected through duct 20*b* and the rest of said $2^{nd}$ flow being injected into the cavity 5 (through duct 223).

This $2^{nd}$ flow of air (or the part of said $2^{nd}$ flow injected into the cavity 5) is preferably for "feeding" the jet or the jets curtain; the pressure effect (by this $2^{nd}$ flow of injected gas) can be made more or less equal to, or is to more or less compensate, the suction effect by the gutter 7. The gaseous flow does not bring about any perturbation of the jet(s). Preferably:

- this $2^{nd}$ flow of air is or comprises air recirculated from the print head;
- while air injected through duct 20*b* (see FIGS. 4A2-4A3) is or comprises dry and cold air, obtained for example from ambient air flowing through a condenser and/or a membrane air drier; in the variant of FIG. 4A3, this air injected through duct 20*b* is mixed with part of the air injected through duct 225.

The air injected through duct 20*b* (possibly mixed with part of air injected through duct 225) is circulated so as not to disturb the trajectory of the ink jet emitted by said print head. In particular, the flow of air circulating under the $2^{nd}$ gutter is preferably kept at a value less than 2-3 m/s, for example about 1 m/s or less.

Figure 4C:
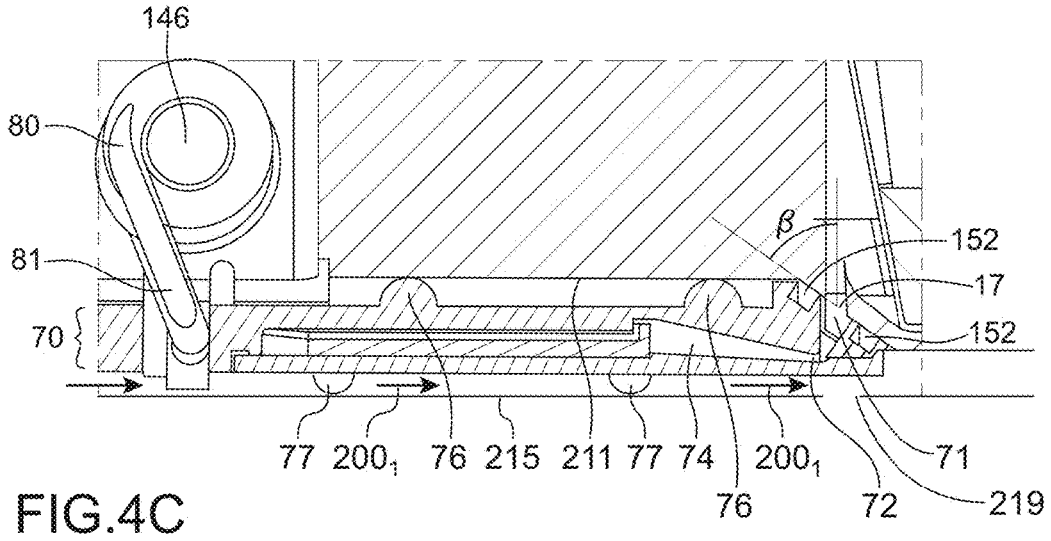

According to an embodiment (FIG. 4C) the outlet face of the cavity is inclined with respect to the flow direction of the jets in the cavity (or to the z axis), for example with an angle β comprised between 10° and 80°; the inlet face of the $2^{nd}$ gutter is also inclined, approximately with the same angle, so that both faces contact with each other, or face each other, when the $2^{nd}$ gutter is closed (as on FIG. 4C).

Just like in the embodiments of FIGS. 4A1-4A3 and 4B, a flow of dry and/or cold air can be injected into the print head, preferably from a lateral side of the head and then the air is oriented so as to circulate under the $2^{nd}$ gutter (see arrows 201), between it and the cover 215 of the head, so that the air is directed just above the outlet slot 219 with the advantages explained above; it is also possible to inject a $2^{nd}$ flow of air through a further duct 225 (see FIGS. 4A1-4A3) and possibly to combine part of said $2^{nd}$ flow with the flow of dry and/or cold air.

Preferably, the $2^{nd}$ gutter comprises the same features, in particular geometrical features, as the $1^{st}$ gutter.

As illustrated on FIG. 4C, the $2^{nd}$ gutter 70 may comprise:

- a $1^{st}$ part which begins at an inlet slot 71 for drops in the gutter;
- a restriction or an elbow 72; the $1^{st}$ part may be inclined from the inlet slot until this restriction; in a particular embodiment the section, or the width, of the $1^{st}$ part, reduces, preferably progressively, on moving away from the plane $P_0$ and the plate 2, from inlet slot 71 to an elbow 72, which makes it possible to confer to the flow of air that circulates in the gutter a velocity that increases from the inlet of the gutter;
- a $2^{nd}$ part 74 follows on from $1^{st}$ part, for example from the elbow 72, in the sense of circulation of drops recovered by the gutter 70; in a preferred embodiment the section of this $2^{nd}$ part, or its width, increases, preferably, on moving away from the plane $P_0$ and on coming closer to the plate 2; which makes it possible to create a Venturi effect. The flow of air that circulates in this part of the gutter has a velocity that decreases. A constant section of this 2nd part, or its width, is possible, but then without creation of Venturi effect.

Figure 4D:
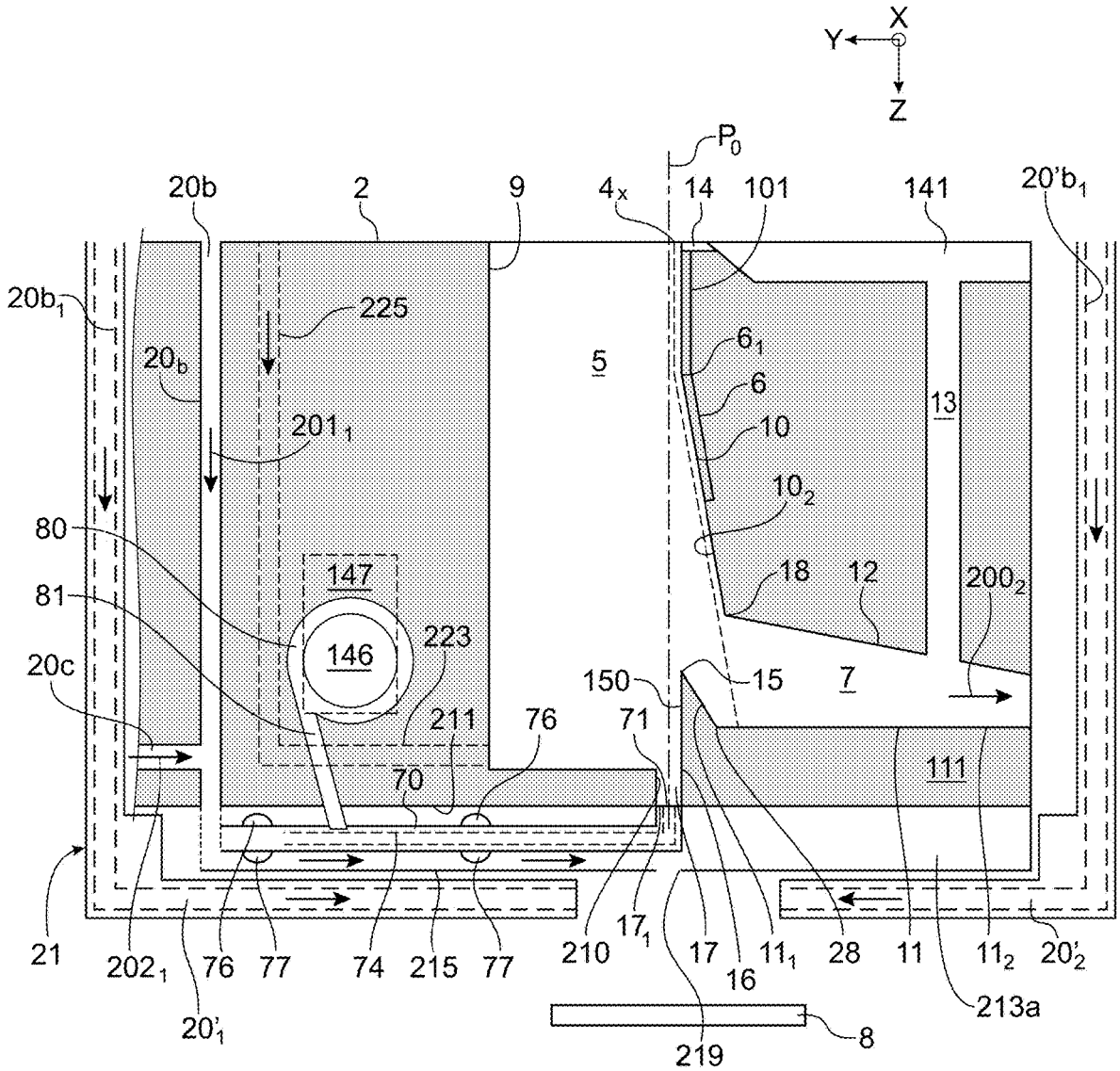

As illustrated on FIG. 4D the additional element 21 of FIG. 3E can be adapted to the print heads of FIGS. 4A1-4C so as to implement the air flow circulating outside the cavity, just below the cover 215 and below the $2^{nd}$ gutter 70. The print head of FIG. 4D is that of FIG. 4A1 but a similar combination can be made with a print head of any of FIGS. 4A2-4A3.

Preferably, air injected between the gutter 70 and the cover 215 (via ducts 20*b*, 20*c*) and through ducts $\mathbf{20'}_1$, $\mathbf{20'}_2$ is or comprises dry air, obtained from ambient air flowing through a condenser and/or a membrane air drier.

Thus air flows:

- above or along the outlet slot 219, or of at least part of it (or along at least part of the inlet of said outlet slot), with the advantages explained above; in the open position of the $2^{nd}$ gutter, the air is also directed just below or along the outlet slot 17, or of at least part of it (or along at least part of the exit $\mathbf{17}_1$ of said outlet slot);
- above or along at least part of the exit of said outlet slot 219, just below cover 215.

These air flows have the advantages already mentioned above. In a specific embodiment, a further internal duct 225 is implemented, like on FIG. 4A2 or 4A3, preferably for injecting into the cavity 5 air recirculated from said cavity. If said duct 225 is connected to duct 20*b* through a duct 227 (like on FIG. 4A3), part (for example 50%) of the recirculated air can be mixed with air injected through duct 20*b*, which is preferably dry and cold air, the mixture being circulated between the gutter 70 and the cover 215.

Figure 5A:
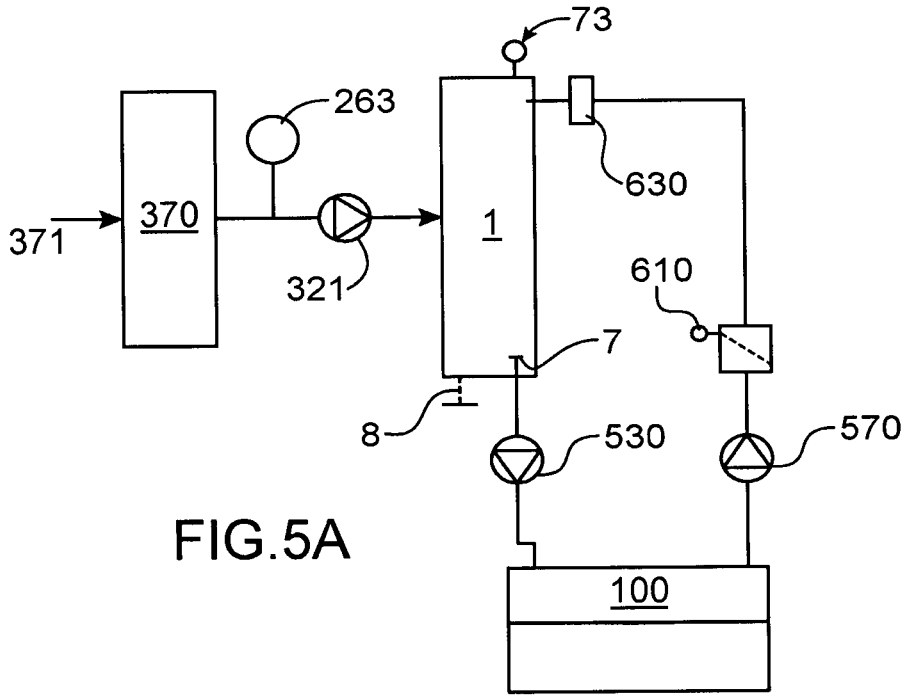
FIGS. 5A-5C are examples of circuits for injecting air according to the invention and (FIGS. 5B-5C) for recirculating air from the print head.
Figure 5B:
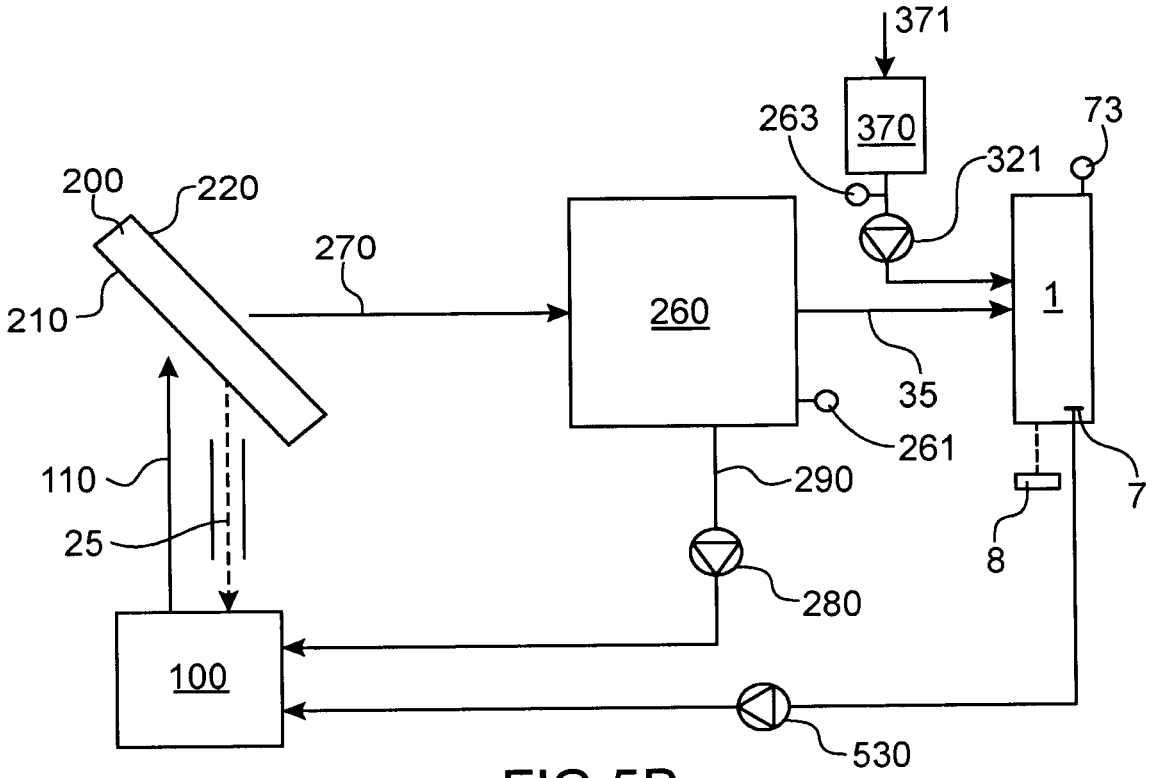
Figure 5C:
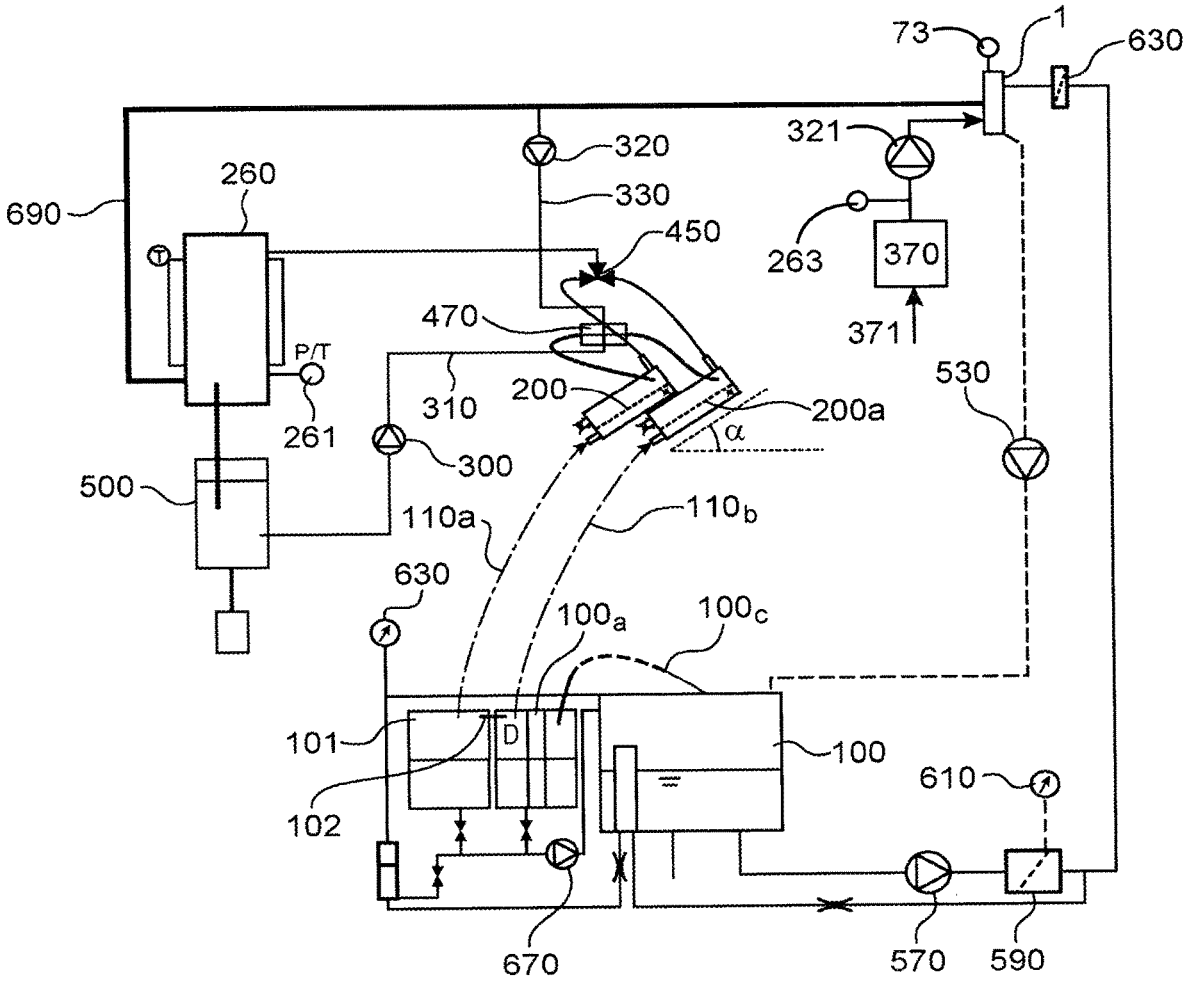

FIGS. 5A-5C show examples of a circuit for injecting air according to the invention; in the examples of FIGS. 5B and 5C, the circuit includes a recirculation circuit, which, here and in this application comprises means for recovering air from the printhead cavity and ink not used for printing, means for recovering solvent—for example with help of a condenser—and means for sending air back to the print head. The air recirculated by this recirculation circuit can be used to inject filtered and dry air through ducts or conduits 225 (FIG. 3B-D, 4A2, 4A3). The active element(s), for example a condenser, of this recirculation circuit can be controlled depending on the thermodynamic conditions (temperature and hygrometry).

The print head can be any of the examples described above, in particular in connection with FIGS. 3A-4D.

FIG. 5A shows the print head 1 and the gutter 7. The print head 1 is supplied with dry and cold air by a device 370 for drying ambient air 371, said device comprising for example a compressor and/or a membrane air dryer. As already explained, both the compressor and the membrane can be controlled depending on the thermodynamic conditions (temperature and hygrometry). A pump can be implemented at the outlet of device 370 to supply print head 1 with air from device 370. One or more sensor(s) 73 can be implemented, for example against the outside wall of a cover containing the print head, to measure the temperature and/or humidity of the ambient air in which the print head is located. Device 370 is implemented in the other embodiments disclosed in connection with FIGS. 5B and 5C. The dry and cold air provided by device 370 can be used to inject dry air through ducts or conduits 20 (FIG. 3A), 20' (FIG. 3B, 3C), $\mathbf{20'}_1$, $\mathbf{20'}_2$ (FIGS. 3D and 4D), 20*b* (FIG. 4A1-4D).

Reference 100 designates an ink reservoir into which ink not consumed during printing will be directed from the gutter 7 through a pump 530 (for example a diaphragm pump).

The reservoir 100 can supply the head 1 with ink; the supply circuit of the head can comprise a pump 570 and two filters 590, 630, the second filter 630 preferably being close to the print head. With this circuit gas can be recirculated to the print head from the reservoir 100. A sensor 610 measures the temperature and/or the hygrometry in the supply pathway to the head 1.

In a variant, the reservoir 100 is not used to supply the head 1 with gas; in other words, only device 370 supplies the print head with gas.

FIG. 5B shows additional elements for recirculating air from the print head and means for recovering solvent.

References 100 again designates an ink reservoir into which ink not consumed during printing will be directed from the gutter 7 through a pump 530 (for example a diaphragm pump).

A flow 110 of vapors from this reservoir 100 can be directed to a filter 200. In return, a liquid flow 25 that is condensed on the inlet surface 210 of the filter can be carried to the reservoir 100 by a duct.

At the outlet from the filter, the flow 270 of filtered vapors is directed to solvent extraction means 260 (for example condensation means), that will condense solvent vapors and produce clean and dry gas 350 that can be returned to the print head 1. It is said that the filter is positioned upstream from the means 260, since the vapors 110 to be treated firstly pass through the filter, and the filtered flow 270 is then directed to the means 260. A sensor 261 can be implemented to measure the temperature and/or humidity of the air in, or at the outlet of, the condenser 260.

The solvent extracted (for example by condensation) can then be carried to the reservoir 100 through an evacuation line 290 that could be provided with a pump 280. The solvent extraction means 260 used may be any means of denaturing a solvent in a gas flow containing it, or any means of extracting a solvent from a gas flow or lowering the concentration of solvent in such a flow, for example by membrane separation or adsorption. Another example of condenser is given in connection with FIGS. 16A and 16B of US-2018-0050543. The remainder of this description applies to condensation means (or a condenser) but all these other examples of solvent extraction means can be used to produce solvent extracted from the gas flow and a gas flow with a reduced solvent concentration. Reference 261 designates a temperature sensor to measure the temperature of the gas at the outlet of said solvent extraction means 260.

Device 370 (already described above) can be included in the circuit, dry and cold air produced by said device can be provided to the print head, as explained above in connection with FIGS. 3B-4D.

FIG. 5C shows another circuit comprising 2 filters 200, 200*a*, for example made of glass fibers; in an embodiment, they can be used in alternation.

On this figure, references identical to references in the previous figures designate identical elements or elements performing the same technical function.

Each of filters 200, 200*a* is connected to a solvent buffer tank 101, 100*a* by a duct 110*a*, 110*b*. On this figure, the reference 500 designates a buffer volume in which condensation products from the solvent extraction means 260 are recovered. Preferably a temperature sensor 261 is implemented to measure the temperature of the gas at the outlet of said solvent extraction means 260. This volume 500 can use a pump 300 to supply filters 200, 200*a* ready to clean them. A pump 670 can pump solvent from the tanks 101, 100*a* to add to the ink in the reservoir 100. The atmosphere of both tanks communicate (for example through a duct 102) so that they operate at a same pressure. Solvent from filter 200 is supplied to buffer tank 101.

The reservoir 100 can be supplied with recovered ink pumped using a pump 530 (for example a diaphragm pump) from the gutter in the print head 1. The flow in the recovery line is two-phase, with a flow equal to, for example, between 0.3 and 10 liters/hour of liquid, and between 10 and 10000 liters/hour of gas, for example 1000 l/hour. This two-phase flow is generated by the pump 530.

The reservoir 100 can supply the head 1 with ink through the pump 570 and a first filter 590 then a second filter 630, close to the print head. A sensor 610 measures the pressure in the supply pathway to the head 1.

The reservoir 100 is connected to tank 100*a* by a duct 100*c*. A separator can be placed between the reservoir 100 and the tank 100*a*. For example, this separator functions by inertial precipitation. It can separate the largest particles contained in the atmosphere arriving from the reservoir 100. Thus, vapors from which the largest particles or pollutants have been removed are sent to the filter 200, 200*a*.

The gas flow from tanks 101, 100*a* is carried due to the positive pressure in the reservoir 100, to the filter 200 or 200*a* which can be connected with the open pathway of a 3-way valve 450. This valve may for example be controlled using a predefined clock.

A separator can be placed between reservoir 100*a* and the filter 200*a* and/or a separator can be placed between reservoir 101 and the filter 200. For example, this separator functions by inertial precipitation. It can separate the largest particles contained in the atmosphere arriving from the corresponding reservoir 100*a* or 101. Thus, vapours from which the largest particles or pollutants have been removed are sent to the corresponding filter 200, 200*a*.

The gas flow is filtered in the selected filter 200 or 200*a* and is then directed to the condenser 260 through the open pathway of the valve 450. A mechanism for separation of condensates from desaturated air carries the condensates in the buffer volume 500, and air through the return line 690, to the print head 1.

Another pathway starting from the buffer volume 500 directs a calibrated quantity of condensates through a pump 300 and controlled valves 470, to the filter 200, 200*a* waiting for maintenance (this is the filter for which the pathway from the 3-way valve 450 is closed). Therefore this solvent flow follows a path opposite the path followed by vapors output from the tank 101, 100*a* and that have to be treated by one of the filters 200, 200*a*: it passes firstly through the downstream side of the filter 200*a* (resp. 200) and then through the filter body, and is then directed to the upstream side of the same filter, cleaning particles deposited on the downstream surface and in the depth of the filter.

After the liquid has passed through the filter(s) during rinsing, another pump 320 connects the desaturated gas pathway to the filters; this gas is directed by two valves 470, for example controlled according to the preconfigured clock. This drying mechanism can also open pores of the filter membrane after having rinsed it.

The desaturated gas thus drawn off is returned to the separator, then to the filter that is not in the maintenance phase.

Consequently, the air flow used starting from line 690 to dry one of the filters in maintenance, circulates in a local loop, which will not have any impact on the net flow transferred to the head 1. Air drawn off by the pump 320 will generate a surplus flow through the filter in maintenance, and is then transferred to the condenser 260 and returned to the line 690, which compensates for the deficit generated by the pump 320. Air drawn off by the pump 320 also generates an overpressure in the reservoir 100, but also in the other filter, through which a higher flow rate circulates since both filters communicate with the same atmosphere. As a variant, air can be brought in from the exterior and then transferred by pumping to the required filter in preparation for drying.

The intensity of this gas flow in the local loop is preferably controlled to minimize the pressure fluctuation in the reservoir 100 and in the gas flow to the return from the print head 1.

As in the system illustrated on FIGS. 5A and 5B, device 370 (already described above) can be included in the circuit, comprising for example a compressor and a membrane air dryer. Air from said device 370 can be provided to the print head, as explained above in connection with FIGS. 3B-4D. Preferably a temperature and hygrometry sensor 263 is implemented to measure the temperature and the hygrometry of the gas at the outlet of said device 370 for producing dry and cold air.

More generally a circuit to recirculate the ink can comprise means to recover solvent, for example as disclosed in US-2018-0050543. Such a circuit can comprise means for injecting air according to the invention, for example like means 370 of FIGS. 5A-5C. Air from said source of dry air can be mixed with air from the recirculation circuit either in the print head (as on FIG. 5C) or upstream of the print head.

Preferably air from said extra source is drier and/or colder than air in any other part of the circuit and of the print head.

In any of the above embodiments of a print head or of a circuit, one or more sensor(s) 73, 610, 261, 263 may be implemented to measure the temperature and/or the hygrometry of the atmosphere around the print head and/or of the air in the recirculation circuit, preferably at the coldest place. Practically, such a sensor 73 can be located close to the print head (for example close or against a cover containing the print head 1) and/or a sensor 261 can be located at the outlet of means 260 (FIGS. 5B and 5C) or in the recirculation loop (sensor 610, FIG. 5A) and/or a sensor 263 can be located at the outlet of means 370 (FIGS. 5A-5C).

Based on the measured temperature(s) and/or hygrometry (ies), for example the temperature measured by sensor 261, the temperature and/or hygrometry of air injected into the print head or along the outlet slot of the print head, for example air supplied by device 370 (FIGS. 5A-C), can be adapted or controlled or regulated. For example, an automatic control based on the partial pressure curve (a curve giving the partial pressure as a function of the temperature, for example the curve of FIG. 2) is implemented with help of the controller of the printer to control the hygrometry and/or the temperature of the air at the outlet of device 370. Preferably the hygrometry and/or the temperature of the air supplied to the print head (said air being injected into the print head or along the outlet slot of the print head) has a temperature and/or hygrometry such that the water vapor pressure is lower than the water vapor pressure defined by 100% humidity at the coldest temperature in the print head and/or in the recirculation circuit; said coldest temperature can be given by the sensor at the outlet of solvent extraction means 260; alternatively, it can be assumed that the coldest temperature in the print head and/or in the recirculation circuit has a predefined difference with respect to a predefined temperature, said predefined temperature being for example a temperature belonging to an operating range of the print head.

A sensor can be implemented to measure a temperature inside the cavity 5 and a sensor can be implemented to measure a temperature at the outlet of the condenser 260 of the recirculation circuit in order to confirm that the temperature measured at the outlet of said condenser is colder than in the cavity. If the temperature measured at the outlet of said condenser is higher than in the cavity, the feeding power of the condenser can be regulated, for example by the controller of the printer.

The volume of a print head according to the invention is of about some $cm^3$, for example between 1 and 2 $cm^3$. The flow of air injected into the cavity or sweeping along the outside of the cavity is adapted accordingly.

Figure 6:
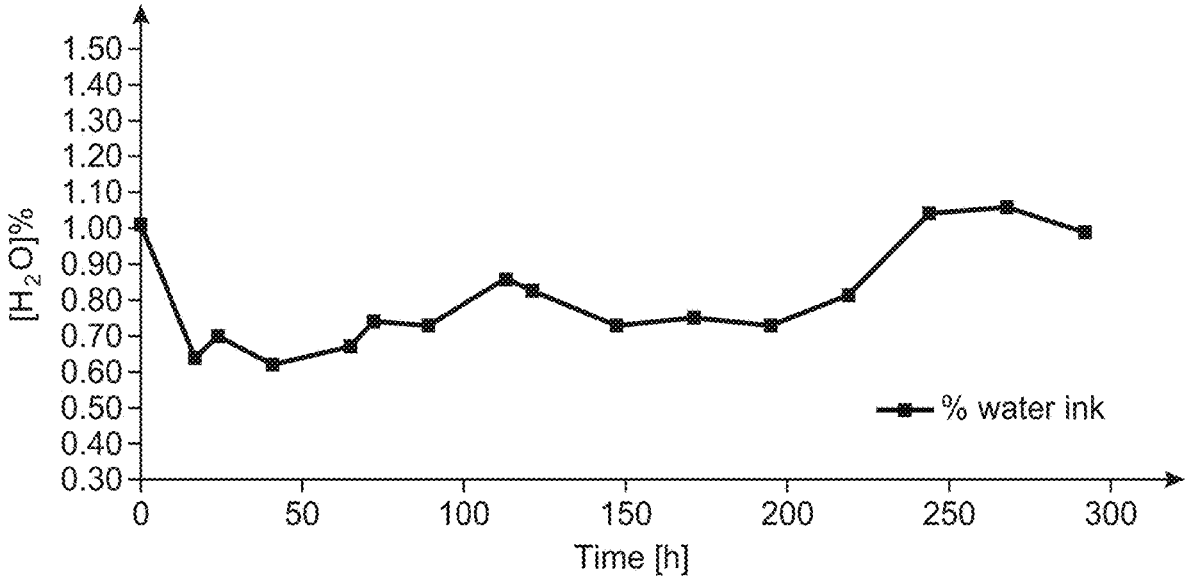
FIG. 6 show results of tests according to the invention.

A test was made over 300 h in a very humid atmosphere (35° C., 80% water). As can be understood from FIG. 6 (which represents the water concentration of ink as a function of time) the ink circuit has kept a stable water concentration during the 300 h. For this test, a head structure as illustrated on FIG. 3B and a recirculation circuit as illustrated on FIG. 5C were implemented, air being recirculated after inertial precipitation, filtration and condensation. The measurements were made by regular sampling (every 1 or 2 days) then by a KarlFisher method performed with help of a laboratory device.

Figure 7:
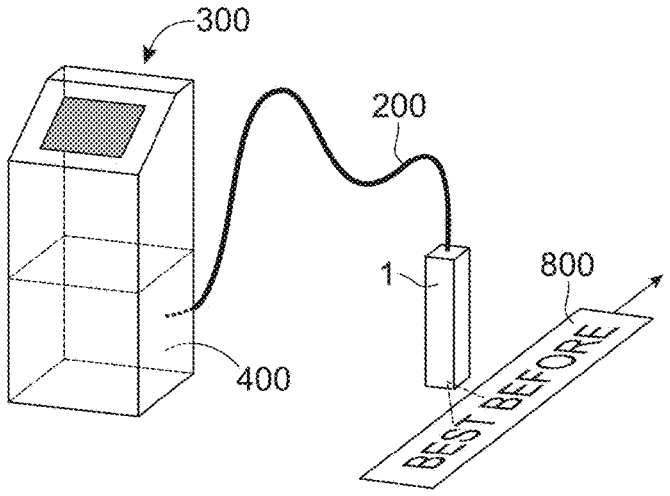
FIGS. 7 and 8 show different aspects of a printer comprising a multi-nozzle ink jet print head that can implement the invention.
Figure 8:
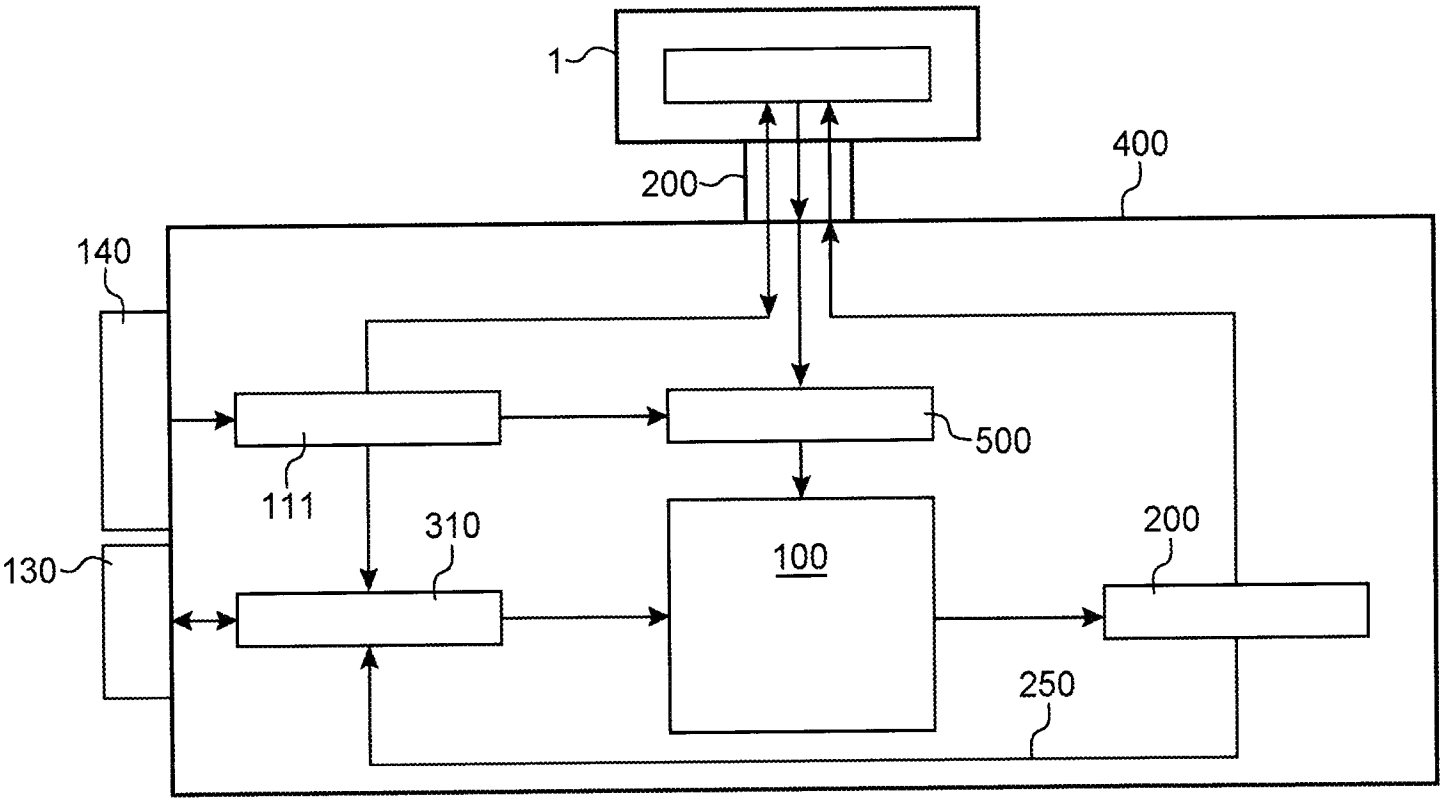
Figure 9A:
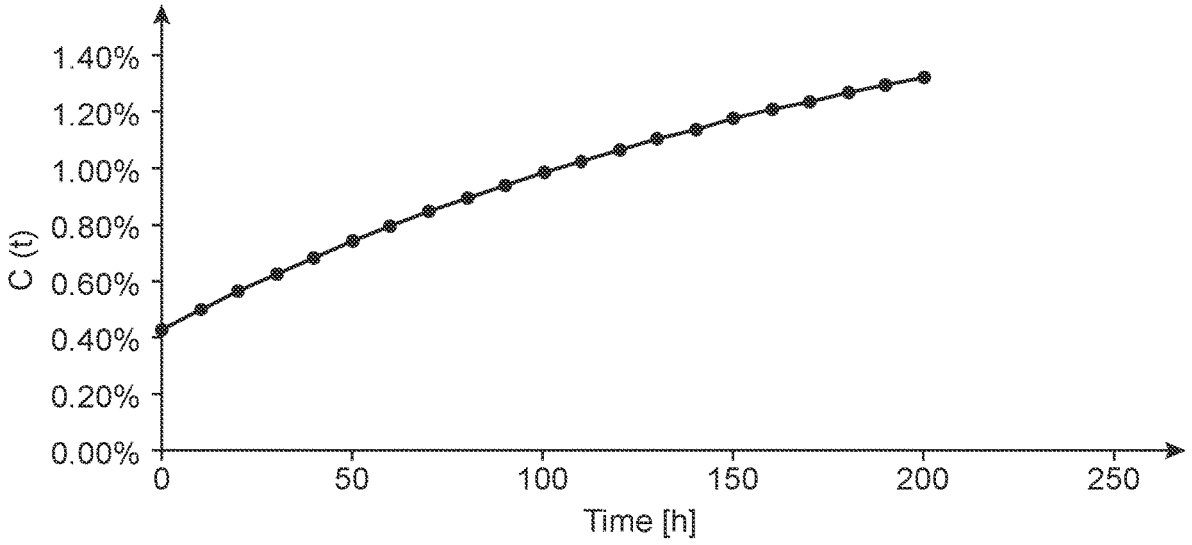
FIG.9A PRIOR ART
FIGS. 9A and 9B show the water concentration in the circuit for a pumping rate of 10 l/h and for a pumping rate of 100 l/h in a known printer.
Figure 9B:
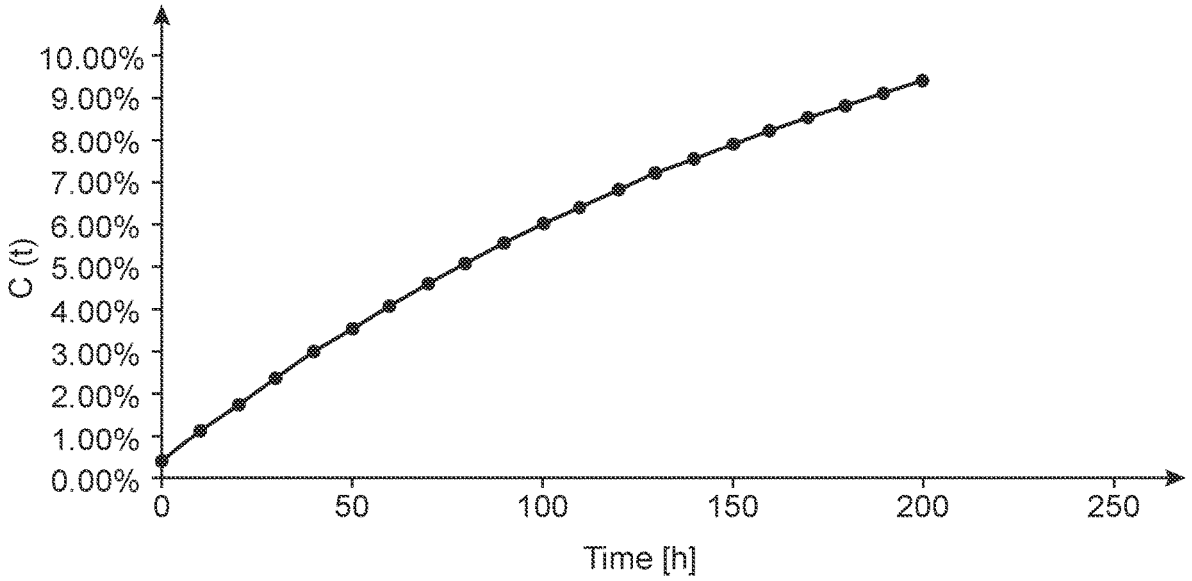
FIG.9B PRIOR ART

A structure of a printer comprising a multi-nozzle ink jet print head according to the invention is illustrated on FIGS. 7 and 8.

Regardless of what embodiment is envisaged, the instructions to activate the print head and to produce ink jets and the gutter pumping means 530 and/or the means (for example a membrane air drier and/or a condenser) forming part of the device 370 for producing dry and cold air and/or the means 570 for sending ink into the print head and/or the means 300, 320 of cleaning the filter are produced and sent by the control means (also called the "controller") and/or the recirculation circuit (in particular a condenser forming part of said recirculation circuit). These are the instructions that, in particular, cause:

- circulation of ink under pressure towards the print head, then generate jets as a function of motifs or patterns to be printed on a support 8 (FIG. 1), 800 (FIG. 7),
- activate and/or regulate the elements forming part of the device 370 and/or of any recirculation circuit in order to regulate the temperature and/or hygrometry of the print head based for example on measurements of the outside temperature and/or hygrometry, as already explained above.

These control means may for example be made in the form of a computer or a processor or a chip, or a programmable electric or electronic circuit, or a microprocessor programmed to implement a method according to the invention.

This controller also controls opening and closing of valves on the path of the different fluids (ink, solvent, gas), and operation of the means of circulating a fluid in the filter means (for example valves 450 and 470 in FIG. 5C), or pumps 300, 320. The control means can also memorize data, for example data for measurement of ink levels in one or more reservoirs, and process these data. The control means can also memorize data of curves like those of FIG. 2, representing the water vapor pressure as a function of temperature.

The control means can receive information or data from one or more sensor(s) measuring temperature and/or humidity and/or water vapor pressure in a part of the circuit or of the head or of the environment (or ambient air) and:

- compare said measured information or data with data of one or more data of the water vapor saturating pressure as a function of temperature; for example one or more data representative of the temperature inside the cavity or the print head can be compared with one or more temperature data of the temperature at the outlet of a condenser inside a recirculation circuit,
- and/or control or regulate the temperature and/or humidity and/or water vapor pressure of air injected into the head (like on FIGS. 3A, 3B) or close to the head (like on FIG. 3C or 4A1-4D), in particular air for flowing along at least part of the outlet slot as explained above, so that temperature and/or humidity and/or water vapor pressure is adapted in order not to condense in the cavity or elsewhere in the circuit; this can be achieved by controlling the pressure difference between both sides of the membrane of a membrane air drier and/or the power of a condenser (for example in device 370). The control means can be specially programmed for keeping air injected into the cavity and/or air flowing along the outlet slot at a target temperature and/or hygrometry and/or water vapor pressure based on measured temperature and/or humidity data and/or on data concerning the vapor saturating pressure of the air (see FIG. 2 for example) at one or more temperature(s).

FIG. 7 shows the main blocks of an inkjet printer (for example a continuous inkjet printer or CIJ printer) that can implement one or several of the embodiments described above.

Such a printer comprises a print head 1 (that can also have the structure illustrated on FIG. 2) and means 200, 300, 400 of supplying printing ink to the head. The print head is connected to a recovery circuit like that described above.

A printer according to the invention may comprise a console 300, a compartment containing particularly the ink and solvent conditioning circuit 400, and reservoirs for ink and solvents (in particular, the reservoir to which ink recovered by the gutter is delivered). In general, this compartment is in the lower part of the console. The top part of the console comprises the control and instrumentation electronics and display means. The console is hydraulically and electrically connected to a print head 1 through an umbilical 200.

Means for maintaining the head, for example a portal frame not shown, are used to install the print head facing a print support 800, which moves along a direction materialized by an arrow. This direction is perpendicular to an alignment axis of the nozzles. Preferably, these means are controlled, through the controller, so that printing can be performed on surfaces which are not flat, for example cables or bottles or cans. In a preferred embodiment, these means can maintain the distance (for example at least between 4 mm and 5 mm, in particular for a CIJ printer) between a printing head and the substrate which must be printed higher than in conventional desk printers.

Examples of print heads that can be used with a device or a method according to the invention are illustrated in FIGS. 3A-4C and have been described above.

An example of a fluid circuit 400 of a printer to which the invention can be applied is illustrated in FIG. 8. This fluid circuit 400 comprises a plurality of means 100, 500, 111, 220, 310, each associated with a special function. There is also the head 1 and the umbilical 200.

This circuit 400 is associated with a removable ink cartridge 130 and a solvent cartridge 140 that is also removable.

Reference 100 designates the main reservoir that collects a mix of solvent and ink.

Reference 111 designates means of drawing off and possibly storing solvent from a solvent cartridge 140 and providing solvent thus drawn off to other parts of the printer, either to supply solvent to the main reservoir 100, or to clean or maintain one or several other parts of the machine.

Reference 310 designates all means of drawing off ink from an ink cartridge 130 and providing ink thus drawn off to supply the main reservoir 100. As can be seen on this figure, according to the embodiment presented herein, these same means 310 are used to send solvent to the main reservoir 100 and from the means 111.

At the outlet from the reservoir 100, a set of means globally designated as reference 220 applies pressure to the ink drawn off from the main reservoir and sends it to the print head 1 (these means can comprise particularly the pump 570, 590 in FIG. 5C above). According to one embodiment illustrated herein by the arrow 250, it is also possible to use these means 220 to send ink to the means 310, and then again to the reservoir 100, which enables recirculation of ink inside the circuit. This circuit 220 is also used to drain the reservoir in the cartridge 130 and to clean connections of the cartridge 130.

The system shown on this figure also includes means 500 of recovering fluids (ink and/or solvent) that return from the print head, more precisely from the gutter 7 of the print head or the head rinsing circuit. Therefore these means 500 are arranged downstream from the umbilical 200 (relative to the direction of circulation of fluids that return from the print head). In particular, they include means 530 in FIG. 5C, but they can also include a solvent vapors treatment circuit according to one embodiment of the invention.

As can be seen in FIG. 8, the means 111 can also be used to send solvent to these means 500 directly without passing through the umbilical 200 or through the print head 1 or through the gutter.

The means 111 can comprise at least 3 parallel solvent supplies, one to the head 1, the 2nd to the means 500 and the 3rd to the means 310.

Each of the means 500, 111, 210, 310 described above can be provided with a pump to treat the fluid concerned (namely 1st pump, 2nd pump, 3rd pump, 4th pump respectively). These different pumps perform different functions (the functions of each of their means) and are therefore different from each other, even though these different pumps may be of the same type or similar types (in other words none of these pumps performs 2 of these functions).

Such a circuit 400 is controlled by the control means described above that are usually contained in the console 300 (FIG. 7).

The invention is particularly useful in applications in which air or a gas flow injected into the cavity in the print head and in the recirculation circuit is high since the risk of entry of humid air into the print head is higher.

For example, the flow may be of the order of several tens of l/h or several hundred l/h, for example between 10 l/h and 1000 l/h (or 5000 l/h), or for example between about 300 l/h (or 500 l/h) and 1000 l/h. These values are particularly applicable to the case of a print head with 64 jets, but the invention is also applicable to the case of a print head with a smaller number of jets, for example 16, or even only 1 jet, or to the case of a print head with a larger number of jets, for example 128.

The printers concerned by the invention are industrial printers, for example which have the ability to print on surfaces which are not flat, for example cables or bottles or cans. Another aspect of such printers is that the distance between the printing head and the substrate which must be printed is higher than in conventional desk printers. For example that distance is at least between 4 mm and 5 mm for a CIJ printer.

Another aspect of such printers is their speed: their maximum speed is up to 10-15 m/s.

Another aspect of such printers is that they can print on very different surfaces, for example glass, or metal or blisters or packaging materials.

The invention claimed is:

1. A continuous ink-jet printer comprising a print head comprising:

a cavity for circulating at least one ink jet, delimited by lateral walls, at least one nozzle for producing at least one ink jet in said cavity, at least one electrode for electrostatically separating drops or sections of one or more of said jet intended for printing from drops or sections that do not serve for printing, a slot, open on the outside of the cavity or of the print head for exit of drops or sections of ink intended for printing, at least one gutter for recovering drops or sections not intended for printing, said ink-jet printer further comprising:

a circuit that generates and circulates dry air along at least one of an inlet part of said slot or an outlet part of said slot to prevent atmospheric humid air from outside the print head from flowing into the print head, said circuit comprising at least one of:

a controller to control at least one of the temperature and the hygrometry of air in at least a portion of said circuit;

a generator of dry air for generating dry air from ambient air.

2. A continuous ink-jet printer according to claim 1, further comprising a recirculation circuit of air and/or ink not used for printing, said recirculation circuit comprising at least a condenser.

3. A continuous ink-jet printer according to claim 1, further comprising at least one sensor to measure at least one of the temperature and the hygrometry in at least one among inside said cavity, outside said cavity, outside said print head, and inside a recirculation circuit of air extracted from said cavity or from said print head and of ink not used for printing.

4. A continuous ink-jet printer according to claim 1, wherein said head comprises a 1$^{st}$ gutter fixed with respect to the head, a $2^{nd}$ gutter movable with respect to the head, said $2^{nd}$ gutter being located between said cavity and a cover comprising an outlet slot, said circuit being for circulating said air between said $2^{nd}$ gutter and said cover and along said outlet slot of said cover.

5. A continuous ink-jet printer comprising a print head comprising:

a cavity for circulating at least one ink jet, delimited by lateral walls, at least one nozzle for producing at least one ink jet in said cavity, at least one electrode for electrostatically separating drops or sections of one or more of said jet intended for printing from drops or sections that do not serve for printing, a slot, open on the outside of the cavity or of the print head for an exit of drops or sections of ink intended for printing, at least one gutter for recovering drops or sections not intended for printing, said ink-jet printer further comprising:

a circuit that generates and circulates dry air along an inlet part of said slot or an outlet part of said slot to prevent atmospheric humid air from outside the print head from flowing into the print head, a recirculation circuit for recirculating air extracted from said cavity, said recirculation circuit providing a flow of recirculated air reinjected into said cavity.

6. A continuous ink-jet printer according to claim 5, said circuit for circulating air along at least part of said slot comprising at least one of:

a generator of dry air for generating dry air from ambient air;

a controller to control at least one of the temperature and the hygrometry of air in at least a portion of said circuit for circulating air along at least one of the inlet part or the outlet part of said slot.

7. A continuous ink-jet printer according to claim 5, said recirculation circuit comprising a condenser.

8. A continuous ink-jet printer according to claim 5, further comprising at least a sensor to measure at least one of the temperature and the hygrometry in at least one among said cavity, outside said cavity, outside said print head and inside said recirculation circuit of air extracted from said cavity or from said print head and of ink not used for printing.

9. A continuous ink-jet printer according to claim 5, wherein said head comprises a $1^{st}$ gutter fixed with respect to the head, a $2^{nd}$ gutter movable with respect to the head, said $2^{nd}$ gutter being located between said cavity and a cover comprising an outlet slot, said circuit being for circulating air between said $2^{nd}$ gutter and said cover and along said outlet slot of said cover.

10. A continuous ink-jet printer comprising a print head comprising:

a cavity for circulating at least one ink jet, delimited by lateral walls, at least one nozzle for producing at least one ink jet in said cavity, at least one electrode for electrostatically separating drops or sections of one or more of said jet intended for printing from drops or sections that do not serve for printing, a slot, open on the outside of the cavity or of the print head for an exit of drops or sections of ink intended for printing, at least one gutter for recovering drops or sections not intended for printing, said ink-jet printer further comprising:

a circuit that generates and circulates dry air along an inlet part of said slot or an outlet part of said slot to prevent atmospheric humid air from outside the print head from flowing into the print head, said circuit comprising at least a generator of dry air for generating dry air, said dry air having a water vapor pressure lower than the water vapor pressure defined by 100% relative humidity at the coldest temperature of the printer, along at least part of the outlet slot of said cavity or of said print head.

* * * * *